United States Patent [19]

Helling et al.

[11] Patent Number: 4,939,077

[45] Date of Patent: Jul. 3, 1990

[54] PHOTOGRAPHIC RECORDING MATERIAL CONTAINING POLYESTER COMPOUNDS HAVING FREE ACID GROUPS

[75] Inventors: Günter Helling, Odenthal; Wolfgang Himmelmann, Leverkusen, both of Fed. Rep. of Germany

[73] Assignee: Agfa-Gevaert Aktiengesellschaft, Leverkusen, Fed. Rep. of Germany

[21] Appl. No.: 399,625

[22] Filed: Aug. 25, 1989

[30] Foreign Application Priority Data

Sep. 8, 1988 [DE] Fed. Rep. of Germany ..... 3830522

[51] Int. Cl.[5] ..... G03C 1/82

[52] U.S. Cl. ..... 430/527; 430/523; 430/627; 430/629; 430/631; 430/634; 430/635; 430/961

[58] Field of Search ..... 430/627, 629, 631, 634, 430/635, 527, 523, 930, 961

[56] References Cited

U.S. PATENT DOCUMENTS

| | | | |
|---|---|---|---|
| 4,232,111 | 11/1980 | Miyazako et al. | 430/961 |
| 4,828,927 | 5/1989 | Timmerman et al. | 430/527 |
| 4,840,881 | 6/1989 | Watanabe et al. | 430/961 |
| 4,879,204 | 11/1989 | Ishigaki et al. | 430/961 |

*Primary Examiner*—Jack P. Brammer

*Attorney, Agent, or Firm*—Connolly & Hutz

[57] ABSTRACT

Photographic silver halide recording material comprising a support, at least one light-sensitive silver halide emulsion layer, a protective layer and optionally other layers, at least one layer which is arranged closer to the support than the protective layer containing a compound which in the form of the free acid corresponds to the following formula (I)

wherein $R_1$ denotes alkylene, arylene, aralkylene or cycloalkylene,

L denotes the residue of a polyester diol having an average molecular weight of from 500 to 20,000, m denotes 0 to 1, n denotes 0 to 30, preferably 0 to 10 and $m+n \geqq 1$, is distinguished by improved properties, in particular an improved maximum density.

6 Claims, No Drawings

PHOTOGRAPHIC RECORDING MATERIAL CONTAINING POLYESTER COMPOUNDS HAVING FREE ACID GROUPS

This invention relates to a photographic recording material comprising a support, at least one light-sensitive silver halide emulsion layer, a protective layer and optionally other layers, the said material having improved properties, in particular an improved maximum density.

It is known from DE-A 22 34 736 to use special polyesters which still contain free carboxylic acid or carboxylate groups as agents for controlling the accumulation of charge in or on surface layers of photographic recording materials. It is not known that these compounds are in any other way suitable for photographic recording materials.

It was an object of the present invention to provide photographic recording materials with improved properties, in particular improved maximum densities.

To solve this problem, the photographic silver halide recording material contains, in at least one layer which is closer to the support than the protective layer, a compound which in the form of free acid corresponds to the following formula:

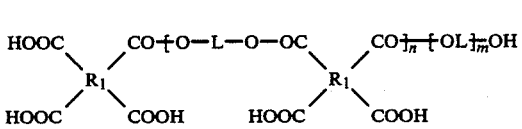

(I)

wherein

R1 denotes alkylene, arylene, aralkylene or cycloalkylene,

L denotes the residue of a polyester diol having an average molecular weight of from 500 to 20,000, m denotes 0 or 1, n denotes a value from 0 to 30, preferably from 0 to 10, and $m + n \geqq 1$.

The polyester carboxylic acids according to the invention have a block structure in which hydrophobic polyester blocks having a molecular weight of ≧500 alternate with hydrophilic blocks carrying two free carboxyl groups.

The polyester carboxylic acids according to the invention preferably have acid numbers of from 30 to 340 mg KOH/g, in particular from 50 to 200 mg KOH/g.

The compounds corresponding to formula I are used in particular as oil formers in their acid form and as surface-active agents and emulsifiers in their anionic form.

As oil formers, they are preferably used in a quantity of from 0.02 to 5.0 g/m², most preferably from 0.2 to 3 g/m², and as surface-active agents they are preferably used in a quantity of from 0.01 to 3.0 g/m², most preferably from 0.05 to 2 g/m².

As oil formers, the compounds according to the invention may be used in any layers in which components of the layer are used in an emulsified form. The same applies to their use as surface-active agents. The compounds according to the invention may assume both the function of oil formers and that of emulsifiers.

The compounds corresponding to formula I are prepared by reacting polyester diols of formula II with carboxylic acid anhydrides of formula III or corresponding di- or tetracarboxylic acids in a molar ratio of from 1:1 to 1:2 at temperatures from 20 to 200° C, optionally in inert solvents:

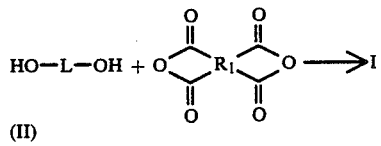

(II) (III)

The condensation reaction is preferably carried out solvent-free, in particular at temperatures from 50 to 150° C.

When the compounds of formula I are used as emulsifiers they are neutralised with alkali metal hydroxides or amines in an aqueous medium. The cations may be $Na^+$, $K^+$, $Li^+$, ammonium, mono-, di-, tri- or tetraalkylammonium or di- or tri-hydroxyalkylammonium.

The alkyl groups mainly contain from one to four carbon atoms.

The polyesterdiols II are known e.g. from Ullmanns Enzyklopadie der technischen Chemie, 4th Edition, Volume 19, pages 305 et seq. They are prepared by the polycondensation of one or more diols with one or more dicarboxylic acids and/or one or more hydroxy acids. Diols and dicarboxylic acids are preferably used. The hydroxy acids may be used as lactones.

Examples of diols include polyalkylene glycols in which the alkylene group has 2 to 4 carbon atoms, such as diethylene glycol, triethylene glycol, polyethylene glycol (average molecular weight about 200 to 1000), 1,2-propylene glycol, 1,3-propylene glycol or polypropylene glycol (average molecular weight about 170 to 1000) or diols corresponding to the general formula $HO\text{-}R_2\text{-}OH$ wherein $R_2$ denotes a divalent hydrocarbon group containing 2 to 13 carbon atoms, such as a straight chained or branched alkylene group or cycloalkylene group (e.g. ethylene-, propylene-, butylene-, isobutylene-, pentylene-. neopentylene-, octylene, tridecylene- and cyclohexylene groups) and groups which are substituted with one or more alkoxy groups containing 1 to 4 carbon atoms (such as ethoxy or propoxy groups), and phenyl groups which may be substituted with one or more alkoxy groups as described above. The following are examples of such diols: Ethylene glycol, propylene glycol, 1,4-butanediol, isobutylenediol. dihydroxyacetone. 1,5.pentanediol, neopentylglycol, 1,6.hexanediol, 1,7-heptanediol, 1.8-octanediol, 1,9.nonanediol, 1,10-decanediol, 1,11-undecanediol, 1,12,dodecanediol, 1,13-tridecanediol, cis- and trans-cyclohexane-1,4-diol, bisphenol A, 1,4-bis-(β-hydroxyethoxy)-benzene and 1,4-bis-(β-hydroxyethoxy)-cyclohexane.

Ethylene glycol, 1,2-propanediol, 1,4-butanediol, 1.6-hexanediol, neopentyl glycol and diethylene glycol are preferred.

Particular examples of suitable dicarboxylic acids include carbonic acid and compounds corresponding to the following general formula:

$HOOC\text{—}(R_3)q\text{—}COOH$ wherein $R_3$ denotes a divalent hydrocarbon group containing up to 12 carbon atoms, for example, a straight chained or branched alkylene group or cycloalkylene group (e.g. a methylene, ethylene, propylene, pentylene, nonylene, dodecylene or 1,1,3-trimethylcyclopentylene group). a group corresponding to the following general formula:

$$-R_4-\overset{\overset{\displaystyle O}{\|}}{C}-R_5-$$

wherein $R_4$ and $R_5$ each denotes a straight chained or branched alkylene group containing up to 11 carbon atoms (for example, a methylene or ethylene group), an alkenylene group (for example, a CH=CH group, a propenylene group or a 1.butenylene group), a phenylene group which may be substituted with one or more halogen atoms (for example, a phenylene or tetrachlorophenylene group), or an alkinylene group (for example, a C≡C or a C≡C-C group) and q has the value 0 or 1, such as: Oxalic acid, malonic acid, succinic acid, glutaric acid, dimethylmalonic acid, adipic acid, pimelic acid, suberic acid, α,α-dimethylsuccinic acid, acetylmalic acid, acetone dicarboxylic acid, azelaic acid, sebacic acid, nonane dicarboxylic acid, decane dicarboxylic acid, undecane dicarboxylic acid, dodecane dicarboxylic acid, fumaric acid, maleic acid, itaconic acid, phthalic acid, isophthalic acid, tetrachlorophthalic acid, mesaconic acid, isopimelic acid, acetylene dicarboxylic acid and glutaconic acid.

The following dicarboxylic acids are preferred: Succinic acid, adipic acid, phthalic acid, sebacic acid and dodecanedicarboxylic acid.

Caprolactone is an example of a suitable lactone of a hydroxycarboxylic acid.

The average molecular weight of the polyester diol of formula (II) determined from the OH number by the end group method is about 500 to 20.000, preferably 800 to 5000. The molar ratio of polyhydric alcohol to polybasic carboxylic acid is greater than 1. Examples of polyester diols are given in Table 1.

TABLE 1

Polyester diols (II)

| Polyester diol | Dicarboxylic acid | Diol | Average mol. wt. | OH number |
|---|---|---|---|---|
| II-1 | Adipic acid | 1,4-Butanediol | 1,500 | 75 |
| II-2 | Adipic acid | Neopentyl glycol | 1,700 | 66 |
| II-3 | Succinic acid | Ethylene glycol | 2,000 | 56 |
| II-4 | Adipic acid | Propylene glycol | 1,200 | 93 |
| II-5 | Sebacic acid | Ethylene glycol | 3,500 | 32 |
| II-6 | Dodecanedicarboxylic acid | Ethylene glycol | 1,900 | 59 |
| II-7 | Succinic acid | Hexanediol | 800 | 140 |
| II-8 | Adipic acid | Diethylene glycol | 2,400 | 46 |
| II-9 | Succinic acid | Neopentyl glycol | 4,200 | 27 |
| II-10 | Adipic acid | Butane-1,4-diol/ Neopentyl glycol 50:50* | 3,200 | 35 |
| II-11 | Adipic acid/ phthalic acid 50:50* | Ethylene glycol | 2,000 | 56 |
| II-12 | Adipic acid | Butane-1,4-diol/ Butane-1,3-diol 50:50* | 2,900 | 39 |

*Mol-%

The following are examples of carboxylic acid anhydrides corresponding to formula (III):

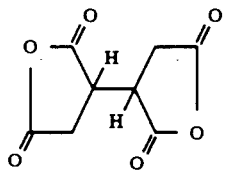
III-1

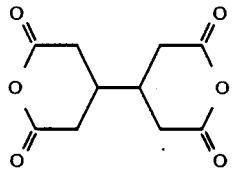
III-2

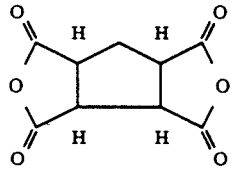
III-3

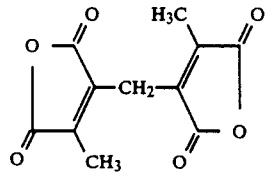
III-4

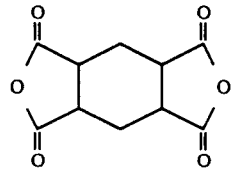
III-5

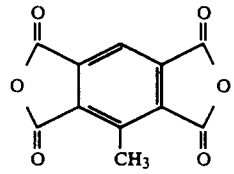
III-6

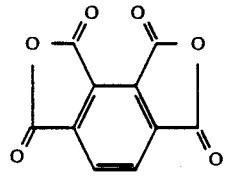
III-7

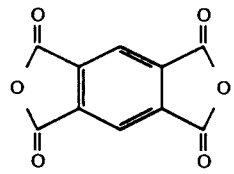
III-8

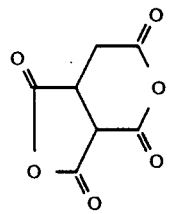
III-9

-continued

III-10

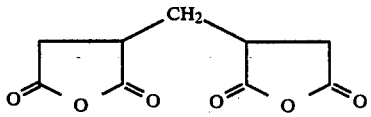

III-11

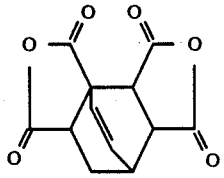

III-12

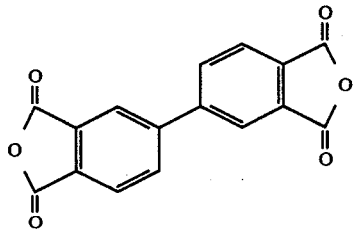

III-13

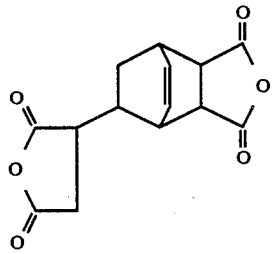

III-14

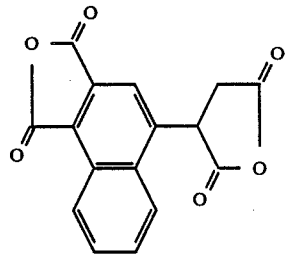

III-15

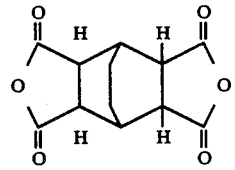

III-16

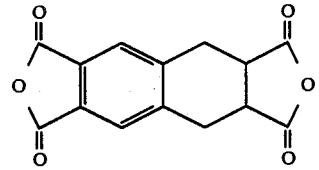

III-17

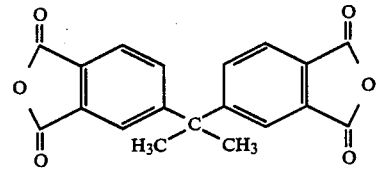

The polyester carboxylic acids according to the invention are soluble in ethyl acetate. As carboxylates they are soluble in water or form colloidal solutions having an average particle size of at the most 100 mm.

The polyester emulsifiers corresponding to the general formula (I) are particularly suitable as emulsifiers for aqueous emulsion polymerisation for the preparation of photographically useful latices. They damage the properties of the latices to a much less extent than conventional emulsifiers. Since they have a relatively high molecular weight compared with conventional emulsifiers and good compatibility with polymers, they do not so easily bleed out of multiphase systems such as mixtures with binders. The transparency of coatings containing these mixtures is improved and the film-forming temperature and brittleness of films and sheet products is improved when polyester diols of the type known as soft segments to the man of the art are used for polymer emulsifiers of formula (I). Polyester diols used as soft segments preferably contain neopentyl glycol and/or $\beta$-hydroxyethyl hexane diol as diol in addition to hexane-1,6-diol and adipic acid as dicarboxylic acid. Caprolactone diols are also known as soft (Angew. Makromol. Chem. 14, 75 (1970) and 16/17, 117 (1971)).

Furthermore, the removal of residual monomers from the polymer latices prepared with the compounds according to the invention is simplified since the compounds corresponding to formula (I) have less tendency to foam than conventional emulsifiers.

The usual monomers may be used for polymerisation in the presence of the emulsifiers according to the invention, e.g. acrylic esters, methacrylic esters, vinyl esters, aromatic vinyl compounds, conjugated dienes, vinyl halides, (meth)acrylonitrile, divinyl compounds and/or (meth)allyl compounds but especially monomers which contain photographically useful groups.

In addition to the monomers mentioned above, watersoluble monomers such as acrylic acid, methacrylic acid, maleic acid, itaconic acid, styrene sulphonic acid, methallyl sulphonic acid, acrylamido-2-methylpropane sulphonic acid or acrylamide may be incorporated in the polymers in quantities of up to 20% if necessary for improving the stability of the polymer latices to the addition of electrolytes.

Latices containing photographically useful groups advantageously prepared with compounds corresponding to formula (I) are known from RD 19 551 (1980), US 4 645 735, US 4 576 910, US 4 551 420, US 4 464 463, DE-OS 3 233 186, DE-OS 3 431 192, DE-OS 3 422 455, DE-OS 3 401 455, DE-OS 3 340 376, DE-OS 3 336 582, DE-OS 3 331 743, EP 0 133 262, DE-OS 3 324 932. DE-OS 3 320 079,DE-OS 3 313 800, DE-0S 3 113 574, DE-OS 3 905 718, EP 0 186 869, US 4 608 424, US 4 612 278, EP 210 409, EP 0 190 003, US 4 557 998, US 4 497 929, DD 235 511, EP 0 121 141, EP 0 107 378, EP 0 186 494 and DD 235 343.

Examples of photographically useful groups include magenta, yellow and cyan colour couplers, white couplers, DIR couplers, UV absorbents, optical brightening agents, masking couplers and filter dyes.

PREPARATION OF THE POLYESTER CARBOXYLIC ACIDS

Polyester carboxylic acid I-1

17.1 g of Polyester diol II-2 obtained from adipic acid and neopentyl glycol and having an average molecular weight of 1,700 and 2,18 g of benzene-1,2,4,5-tetracarboxylic acid (96% by weight) are mixed together, the mixture is heated to 160° C for 4 hours and the water formed in the reaction is distilled off. A clear, homogenous polyester carboxylic acid having an acid number of 73 mg KOH/g is obtained on cooling.

Polyester carboxylic acid I-2

25.5 g of Polyester diol II-12 and 2.8 g of benzene-1,2,4,5-tetracarboxylic acid (96% by weight) are mixed together and heated to 160° C for 2 hours with stirring and the water formed is distilled off. A homogeneous, slightly cloudy polyester cargoxylic acid having an acid number of 70 mg KOH/g is obtained on cooling.

Polyester carboxylic acid I-3

17.1 g of Polyester diol II-2 and 4.36 g of benzene-1,2,4,5-tetracarboxylic acid (96% by weight) are mixed together and heated to 160° C for 5 hours with stirring and the water formed is distilled off. A clear, homogeneous polyester carboxylic acid having an acid number of 144 mg KOH/g is obtained on cooling.

The other polyester carboxylic acids shown in Table 2 are obtained in analogous manner by the reaction of polyester diols II with carboxylic acid anhydrides.

TABLE 2

| Polyester carboxylic acid | Polyester diol | Carboxylic acid anhydride | Molar ratio polyester diol/ carboxylic acid anhydride | Acid number |
|---|---|---|---|---|
| I-4 | II-1 | III-2 | 1:1.5 | 122 |
| I-5 | II-1 | III-5 | 1:1 | 65 |
| I-6 | II-2 | III-6 | 1:1 | 58 |
| I-7 | II-4 | III-5 | 1:1.5 | 146 |
| I-8 | II-7 | III-8 | 1:1 | 110 |
| I-9 | II-9 | III-7 | 1:2 | 72 |
| I-10 | II-10 | III-12 | 1:2 | 92 |
| I-11 | II-10 | III-8 | 1:2 | 98 |
| I-12 | II-6 | III-10 | 1:2 | 150 |
| I-13 | II-2 | III-5 | 1:2 | 156 |

The following are examples of colour photographic materials: Colour negative films, colour reversal films, colour positive films, colour photographic paper, colour reversal photographic paper and colour sensitive materials for the dye diffusion transfer process or the silver dye bleaching process.

Examples of suitable supports for the preparation of colour photographic materials include films and sheets of semi-synthetic and synthetic polymers such as cellulose nitrate, cellulose acetate, cellulose butyrate, polystyrene, polyvinyl chloride, polyethylene terephthalate and polycarbonate and paper laminated with a baryta layer or an α-olefine polymer layer (e.g. polyethylene). These supports may be coloured with dyes and pigments, e.g. titanium dioxide. They may also be coloured black for shielding off light. The surface of the support is generally subjected to a treatment to improve adherence of the photographic emulsion layer, e.g. corona discharge followed by application of a substrate layer.

The colour photographic materials generally contain at least one red-sensitive, one green-sensitive and one blue-sensitive silver halide emulsion layer and optionally interlayers and protective layers.

Binders, silver halide grains and colour couplers are essential components of the photographic emulsion layers.

The binder used is preferably gelatine but this may be partly or completely replaced by other synthetic, semi-synthetic or naturally occurring polymers. Examples of synthetic gelatine substitutes include polyvinyl alcohol, poly-N-vinyl pyrrolidone, polyacrylamides and polyacrylic acid and derivatives thereof, in particular the copolymers. Examples of naturally occurring gelatine substitutes include other proteins, such as albumin or casein, cellulose, sugar, starch and alginates. Semi-synthetic gelatine substitutes are generally modified natural products. Cellulose derivatives such as hydroxyalkyl cellulose, carboxymethyl cellulose and phthalyl cellulose and gelatine derivatives obtained by the reaction with alkylating or acylating agents or by grafting polymerisable monomers are examples of these.

The binders should have a sufficient quantity of functional groups to be able to give rise to sufficiently resistant layers by a reaction with suitable hardeners. These functional groups may be, in particular, amino groups or carboxyl groups, hydroxyl groups or active methylene groups.

Gelatine, which is the binder preferably used, may be obtained by acid or alkaline decomposition but oxidized gelatine may also be used. The preparation of such gelatines is described, for example, in The Science and Technology of Gelatine, published by A. G. Ward and A. Courts, Academic Press 1977, pages 295 et seq. The gelatine should be as free as possible of photographically active impurities (inert gelatine). Gelatines having a high viscosity and low swelling are particularly advantageous.

The silver halide present as light-sensitive component of the photographic material may contain chloride, bromide, iodide or mixtures thereof. For example, the halide content of at least one layer may be composed of 0 to 15 mol-% of iodide, 0 to 100 mol-% of chloride and 0 to 100 mol-% of bromide. Silver iodobromide emulsions are generally used for colour negative and colour reversal films while silver chlorobromide emulsions are usually used for colour negative and colour reversal paper. The halides may consist predominantly of contact crystals which may be, e.g. regular cubes or octahedrons or transitional forms. The halides may also contain platelet-shaped crystals in which the average ratio of diameter to thickness is preferably at least 5:1. the diameter of a grain being defined as the diameter of a circle having a surface area corresponding to the projected surface area of the grain. The layers may also contain tabular silver halide crystals in which the ratio of diameter to thickness is substantially greater than 5:1, e.g. from 12:1 to 30:1.

The silver halide grains may also have a multilayered grain structure, in the simplest case with an inner and an outer region (core/shell) which differ from one another in their halide composition and/or other modifications, such as doping. The average grain size of the emulsions is preferably from 0.2 μm to 2.0 μm and the grain size distribution may be either homodisperse or heterodisperse. A grain size distribution is homodisperse when 95% of the grains deviate by not more than ±30% the average grain size. The emulsions may contain organic silver salts in addition to the silver halide, e.g. silver benzotriazolate or silver behenate.

Two or more types of separately prepared silver halide emulsions may be used as a mixture.

The photographic emulsions may be prepared from soluble silver salts and soluble halides by various methods (e.g. P. Glafkides. Chimie et Physique Photographique, Paul Montel, Paris (1967). G. F. Duffin, Photographic Emulsion Chemistry, The Focal Press, London (1966), V. L. Zelikman et al, Making and Coating Photographic Emulsions, The Focal Press, London (1966)).

Precipitation of the silver halide is preferably carried out in the presence of the binder, e.g. gelatine, and may be carried out in an acid, neutral or alkaline pH, preferably with the addition of silver halide complex formers. The latter include, e.g. ammonia, thioethers, imidazole, ammonium thiocyanate and excess halide. The water-soluble silver salts and the halides may be brought together as desired either successively by the single jet process or simultaneously by the double jet process or by any combination of the two processes. They are generally added at increasing inflow rates but without exceeding the "critical" inflow rate at which new nuclei just fail to be formed. The pAg range may vary within wide limits during precipitation. The so-called pAg controlled process is preferably employed, in which the pAg is either kept constant at a particular value or arranged to pass through a predetermined pAg profile during the precipitation. Instead of the preferred method of precipitating with a halide excess, the method of so-called inverse precipitation with an excess of silver ions may be employed. Growth of the silver halide crystals may be achieved not only by precipitation but also by physical ripening (Ostwald ripening) in the presence of excess halide and/or silver halide complex formers. The growth of the emulsion grains may in fact take place predominantly by Ostwald ripening, in which case a fine grained, so-called Lippmann emulsion is preferably mixed with a more sparingly soluble emulsion and redissolved on the latter.

Salts or complexes of metals such as Cd, Zn, Pb, Tl, Bi, Ir, Rh or Fe may be present during the precipitation and/or physical ripening of the silver halide grains.

The precipitation may also be carried out in the presence of sensitizing dyes. Complex forming agents and/or dyes may be rendered inactive at any stage. e.g. by altering the pH or by an oxidative treatment.

When crystal formation has been completed or at an earlier stage, the soluble salts are removed from the emulsion, e.g. by shredding and washing, by flocculation and washing, by ultrafiltration or by means of ion exchangers.

The silver halide emulsion is generally subjected to a chemical sensitization under specified conditions of pH, pAg, temperature and concentration of gelatine, silver halide and sensitizer until the sensitivity and fog optimum are reached. The procedure is described e.g. in "Die Grundlagen der Photographischen Prozesse mit Silberhalogeniden" by H. Frieser, pages 675-734. published by Akademische Verlagsgesellschaft (1968).

Chemical sensitization may be carried out with the addition of compounds of sulphur, selenium or tellurium and/or metal compounds, e.g. compounds of gold, platinum, palladium, iridium or rhodium. Thiocyanate compounds, surface-active compounds such as thioethers, heterocyclic nitrogen compounds (e.g. imidazoles, azaindenes) and spectral sensitizers may also be added (described e.g. in "The Cyanine Dyes and Related Compounds", by F. Hamer, 1964, and Ullmanns Encyclopadie der technischen Chemie, 4th Edition, Volume 18, pages 431 et seq and Research Disclosure No.17643, Section III). In addition to or instead of chemical sensitization, reduction sensitization may be carried out with the addition of reducing agents (tin-II salts, amines, hydrazine derivatives, amino boranes, silanes or formamidine sulphinic acid) or by means of hydrogen or adjustment to a low pAg (e.g. below 5) and/or a high pH (e.g. above 8).

The photographic emulsions may contain compounds for preventing fog formation or for stabilizing the photographic function during production, storage or photographic processing.

Azaindenes are particularly suitable, especially tetra and penta-azaindenes, in particular those which are substituted with hydroxyl or amino groups. Compounds of this type are described e.g. by Birr. Z.Wiss.Phot. 47 (1952), pages 2–58. Salts of metals such as mercury or cadmium, aromatic sulphonic or sulphinic acids such as benzene sulphinic acid and nitrogen-containing heterocyclic compounds such as nitrobenzimidazole, nitroindazole or substituted or unsubstituted benzotriazoles or benzothiazol ium salts may also be used as antifoggants. Heterocyclic compounds containing mercapto groups are particularly suitable, e.g. mercaptobenzothiazoles, mercaptobenzimidazoles, mercaptotetrazoles, mercaptothiadiazoles and mercaptopyrimidines. These mercaptoazoles may contain a water-solubilizing group, e.g. a carboxyl group or a sulpho group. Other suitable compounds are published in Research Disclosure No.17643 (1968), Section VI.

The stabilizers may be added to the silver halide emulsions before, during or after ripening. The compounds may, of course, be added to other photographic layers associated with a silver halide layer.

Mixtures of two or more of the above-mentioned compounds may also be used.

The photographic emulsion layers or other hydrophilic colloid layers of the light-sensitive material prepared according to the invention may contain surface-active agents for various purposes, such as coating auxiliaries or agents for preventing the accumulation of electric charges, for improving the slip properties, for emulsifying the dispersion, for preventing adhesion and for improving the photographic characteristics (e.g. development acceleration, high contrast, sensitization, etc.). In addition to natural surface active compounds such as saponin, synthetic surface active compounds are mainly used, including non-ionic surface active compounds such as alkylene oxide compounds, glycerol compounds or glycidol compounds, cationic surface-active agents such as higher alkylamines, quaternary ammonium salts, pyridine compounds and other heterocyclic compounds, sulphonium compounds or phosphonium compounds, anionic surface active agents containing an acid group, e.g. a carboxylic acid, sulphonic acid, phosphoric acid, sulphuric acid ester or phosphoric acid ester group, and ampholytic surface active agents such as amino acid and amino sulphonic acid compounds and sulphuric and phosphoric acid esters of an amino alcohol, but especially the carboxylates according to the invention.

The photographic emulsions may be spectrally sensitized with methine dyes or other dyes. Cyanine dyes, merocyanine dyes and complex merocyanine dyes are particularly suitable.

A survey of polymethine dyes suitable as spectral sensitizers, suitable combinations of these dyes and combinations which have a supersensitizing action may be found in Research Disclosure 17643/1978. Section IV.

The following dyes, grouped according to their spectral regions, are particularly suitable:

1. as red sensitizers

9-Ethylcarbocyanines containing benzothiazole, benzoselenazole or naphthothiazole as basic end groups, optionally substituted in the 5 and/or 6-position by halogen. methyl, methoxy, carbalkoxy or aryl: and 9.ethyl-naphthoxathia and -selenocarbocyanines and 9-ethyl-naphthothiaoxa- and -benzimidazocarbocyanines, provided the dyes carry at least one sulphoalkyl group on the heterocyclic nitrogen.

2. as green sensitizers 9.Ethylcarbocyanines containing benzoxazole, naphthoxazole or a benzoxazole and a benzothiazole as basic end groups and benzimidazocarbocyanines which may also be further substituted and must also contain at least one sulphoalkyl group on the heterocyclic nitrogen.

3. as blue sensitizers

Symmetric or asymmetric benzimidazo-, oxa-, thia-or selenacyanines containing at least one sulphoalkyl group on the heterocyclic nitrogen and optionally other substituents on the aromatic nucleus, and apomero cyanines containing a rhodanine group.

The following red sensitizers RS, green sensitizers GS and blue sensitizers BS are given as examples used either singly or in combination, in particular for negative and reversal films, e.g. RS 1 and RS 2 or GS 1 and GS 2.

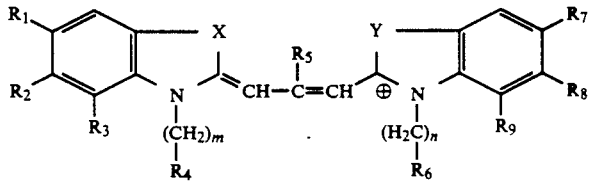

RS 1: $R_1, R_3, R_7, R_9 = H$; $R_2, R_8 = Cl$; $R_4 = SO_3^{\ominus\oplus}NH(C_2H_5)_3$; $R_5 = C_2H_5$; $R_6 = SO_3^{\ominus}$; $m, n = 3$; $X, Y = S$;

RS 2: $R_1, R_3, R_9 = H$; $R_2$ = Phenyl; $R_4 = -\underset{\underset{CH_3}{|}}{CH}-SO_3^{\ominus}K^{\oplus}$; $R_5 = C_2H_5$; $R_6 = SO_3^{\ominus}$; $R_7, R_8 = -OCH_3$; $m = 2$; $n = 3$; $x = O$; $Y = S$;

RS 3: $R_1, R_9 = H$; $R_2, R_3$ together $= -CH{=}CH-CH{=}CH-$; $R_4 = SO_3^{\ominus}Na^{\oplus}$; $R_5 = C_2H_5$; $R_6 = SO_3^{\ominus}$; $R_7, R_8 = Cl$; $m, n = 3$; $X = S$; $Y = N-C_2H_5$;

RS 4: $R_1 = OCH_3$; $R_2, R_8 = CH_3$; $R_3, R_4, R_7, R_9 = H$; $R_5 = C_2H_5$; $R_6 = SO_3^{\ominus}$; $m = 2$; $n = 4$; $X = S$; $Y = Se$;

RS 5: $R_1, R_7 = H$; $R_2, R_3$ sowie $R_8, R_9$ together $= -CH{=}CH-CH{=}CH-$; $R_4 = SO_3^{\ominus\oplus}NH(C_2H_5)_3$; $R_5 = C_2H_5$; $R_6 = SO_3^{\ominus}$; $m = 2$; $n = 3$; $X, Y = S$;

GS 1: $R_1, R_3, R_7, R_9 = H$; $R_2$ = Phenyl; $R_4 = \underset{\underset{CH_3}{|}}{CH}-SO_3^{\ominus\oplus}NH(C_2H_5)_3$; $R_5 = C_2H_5$; $R_6 = SO_3^{\ominus}$; $R_8 = Cl$; $m = 2$; $n = 3$; $X, Y = O$;

GS 2: $R_1, R_2, R_7, R_8 = Cl$; $R_3, R_5, R_6, R_9 = H$; $R_4 = -\underset{\underset{CH_3}{|}}{CH}-SO_3^{\ominus}$; $m, n = 2$; $X, Y = N-C_2H_5$;

GS 3: $R_1, R_7 = H$; $R_2, R_3$ and $R_8, R_9$ together $= -CH{=}CH-CH{=}CH-$; $R_4 = SO_3^{\ominus}Na^{\oplus}$; $R_5 = C_2H_5$; $R_6 = SO_3^{\ominus}$; $m, n = 3$; $X, Y = O$;

GS 4: $R_1, R_3, R_4, R_7, R_8, R_9 = H$; $R_2 = OCH_3$; $R_5 = C_2H_5$; $R_6 = SO_3^{\ominus}$; $m = 2$; $n = 4$; $X = O$; $Y = S$;

BS 1:

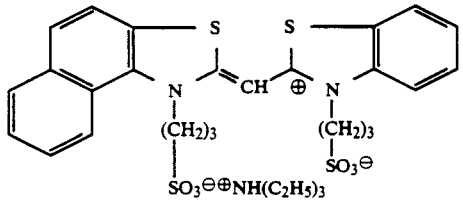

BS 2:

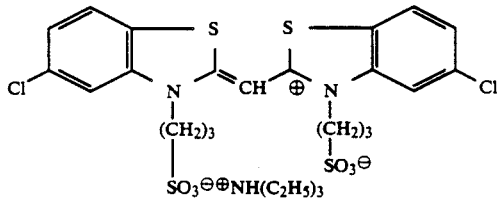

-continued

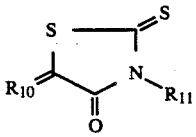

BS 3:

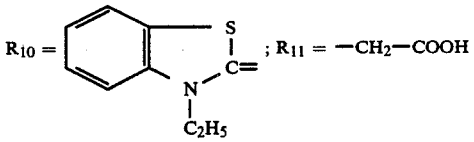

BS 4:

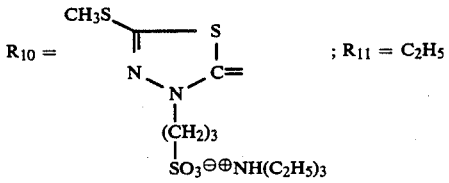

BS 5:

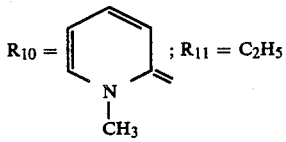

Sensitizers may be omitted if the intrinsic sensitivity of the silver halide is sufficient for a particular spectral region, for example the blue sensitivity of silver bromides.

Non-diffusible monomeric or polymeric colour couplers may be associated with the differently sensitized emulsion layers. These couplers may be situated in the layer with which they are associated or in an adjacent layer. Cyan couplers are generally associated with the red-sensitive layers, magenta couplers with the green-sensitive layers and yellow couplers with the blue-sensitive layers.

The colour couplers used for producing the cyan partial colour image are generally couplers of the phenol or α-naphthol series. The following are suitable examples of these:

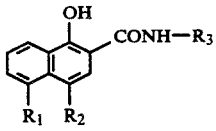

BG 1: $R_1$ = H; $R_2$ = H;

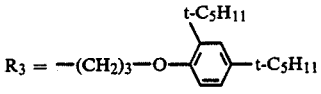

BG 2: $R_1$ = —NHCOOCH$_2$—CH(CH$_3$)$_2$; $R_2$ = H;
$R_3$ = —(CH$_2$)$_3$—OC$_{12}$H$_{25}$

BG 3: $R_1$ = H; $R_2$ = —OCH$_2$—CH$_2$—SO$_2$CH$_3$;
$R_3$ = C$_{16}$H$_{33}$

BG 4: $R_1$ = H; $R_2$ = —OCH$_2$—CONH—(CH$_2$)$_2$—OCH$_3$;

-continued

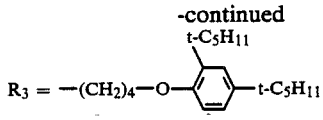

BG 5: $R_1$ = H; $R_2$ = H;

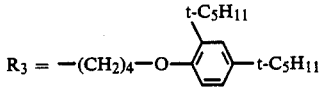

BG 6: $R_1$ = H; $R_2$ = H;

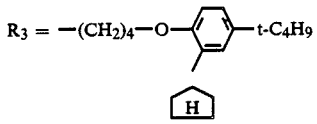

BG 7: $R_1$ = H; $R_2$ = Cl;
$R_3$ = —C(C$_2$H$_5$)$_2$—(CH$_2$)$_{20}$—CH$_3$

BG 8: $R_1$ = H;
$R_2$ = —O—CH$_2$—CH$_2$—S—CH(COOH)—C$_{12}$H$_{25}$
$R_3$ = Cyclohexyl

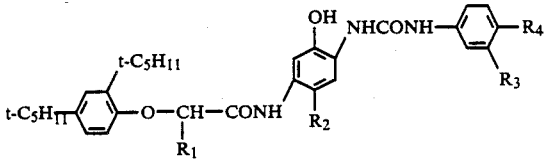

BG 9: $R_1$ = —C$_4$H$_9$; $R_2$ = H; $R_3$ = —CN; $R_4$ = Cl

BG 10: $R_1$ = —C$_4$H$_9$; $R_2$ = H; $R_3$ = H; $R_4$ = —SO$_2$CHF$_2$

-continued

BG 11: $R_1 = -C_4H_9$;

$R_2 = -O-$ 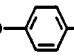 $-C(CH_3)_2-CH_2$-t-$C_4H_9$;

$R_3 = H$; $R_4 = -CN$

BG 12: $R_1 = C_2H_5$; $R_2 = H$; $R_3 = H$; $R_4 = -SO_2CH_3$

BG 13: $R_1 = -C_4H_9$; $R_2 = H$; $R_3 = H$; $R_4 = -SO_2-C_4H_9$

BG 14: $R_1 = -C_4H_9$; $R_2 = H$; $R_3 = -CN$; $R_4 = -CN$

BG 15: $R_1 = -C_4H_9$; $R_2 = H$; $R_3 = H$;
$R_4 = -SO_2-CH_2-CHF_2$

BG 16: $R_1 = -C_2H_5$; $R_2 = H$; $R_3 = H$;
$R_4 = -SO_2CH_2-CHF-C_3H_7$

BG 17: $R_1 = -C_4H_9$; $R_2 = H$; $R_3 = H$; $R_4 = F$

BG 18: $R_1 = -C_4H_9$; $R_2 = H$; $R_3 = H$; $R_4 = -SO_2CH_3$

BG 19: $R_1 = -C_4H_9$; $R_2 = H$; $R_3 = H$; $R_4 = -CN$

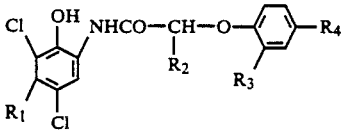

BG 20: $R_1 = -CH_3$; $R_2 = -C_2H_5$; $R_3$, $R_4$ = -t-$C_5H_{11}$

-continued

BG 21: $R_1 = -CH_3$; $R_2 = H$; $R_3$, $R_4$ = -t-$C_5H_{11}$

BG 22: $R_1 = -C_2H_5$; $R_2 = -C_2H_5$; $R_3$, $R_4$ = -t-$C_5H_{11}$

BG 23: $R_1 = -C_2H_5$; $R_2 = -C_4H_9$; $R_3$, $R_4$ = -t-$C_5H_{11}$

BG 24: $R_1 = -C_2H_5$; $R_2 = -C_4H_9$; $R_3$, $R_4$ = -t-$C_4H_9$

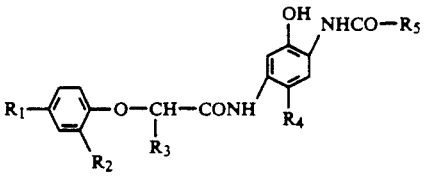

BG 25: $R_1$, $R_2$ = -t-$C_5H_{11}$; $R_3 = -C_4H_9$; $R_4 = H$; $R_5 = -C_3F_7$

BG 26: $R_1 = -NHSO_2-C_4H_9$; $R_2 = H$; $R_3 = -C_{12}H_{25}$; $R_4 = Cl$;
$R_5$ = Phenyl BG 27: $R_1$, $R_2$ = -t-$C_5H_{11}$; $R_2 = Cl$, $R_3 = -CH(CH_3)_2$;
$R_4 = Cl$; $R_5$ = Pentaflorphenyl BG 28: $R_1$ = -t-$C_5H_{11}$; $R_2 = Cl$; $R_3 = -C_6H_{13}$; $R_4 = Cl$;
$R_5$ = -2-Chlorphenyl Colour couplers for producing the magenta partial colour image are generally couplers of the 5-pyrazolone series, the indazolone series or the pyrazoloazole series. The following are suitable examples of these:

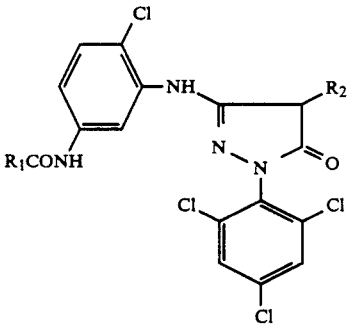

PP 1: $R_1 = -O-CH(CH_3)-CH_2-O-$ 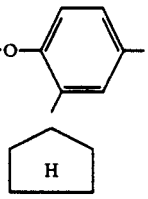 -t-$C_4H_9$; $R_2 = H$

PP 2: $R_1 = -CH(C_{12}H_{25})-O-$ 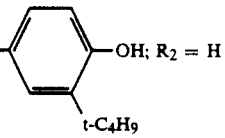 -OH; $R_2 = H$

PP 3: $R_1 = -C_{13}H_{27}$; $R_2 = H$

PP 4: $R_1 = -O-C_{16}H_{33}$; $R_2 = H$

-continued
PP 5: $R_1 = -C_{13}H_{27}$; $R_2 =$ 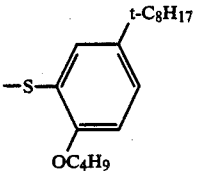
PP 6: $R_1 =$ 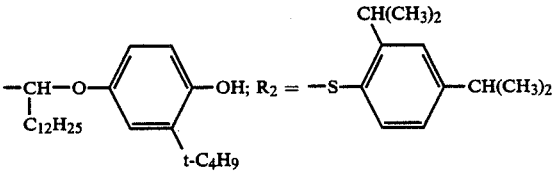
PP 7: $R_1 = -C_9H_{19}$; $R_2 =$ 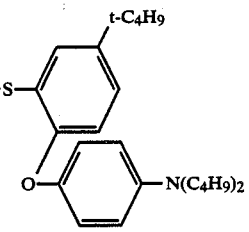
PP 8: $R_1 =$ 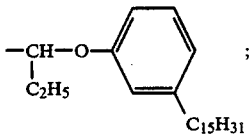 ; $R_2 =$ 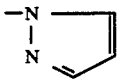
PP 9: 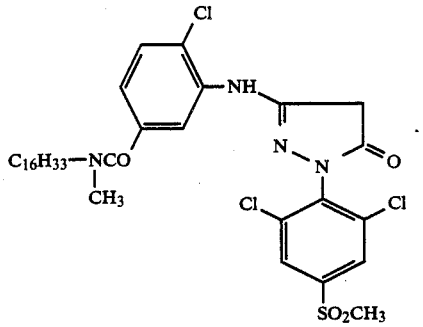
PP 10: 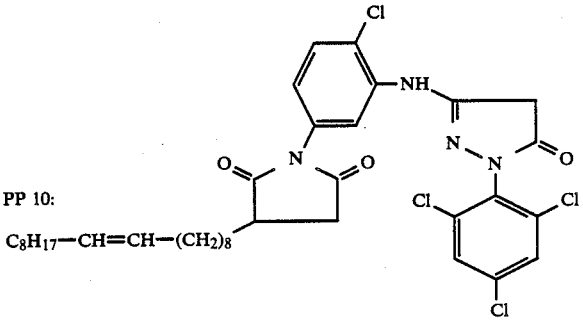

-continued
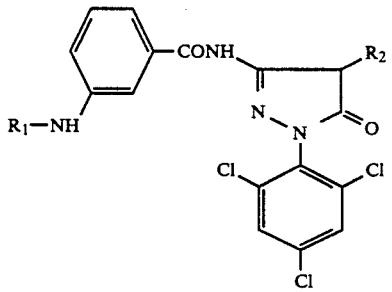
PP 11: $R_1$ = 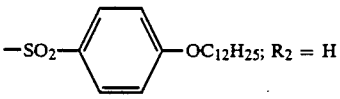 $R_2$ = H
PP 12: $R_1$ = 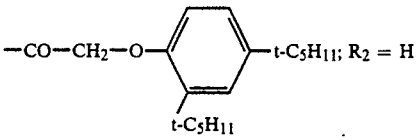 $R_2$ = H
PP 13: $R_1$ = 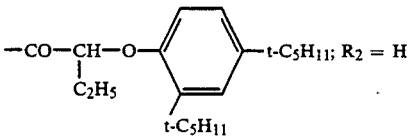 $R_2$ = H
PP 14: $R_1$ = 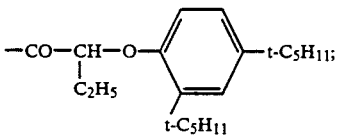
$R_2$ = 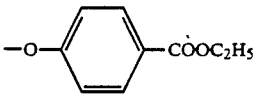
PP 15: 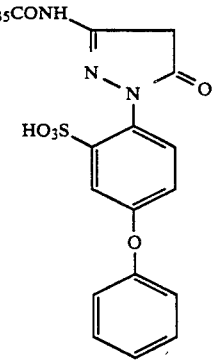

-continued
PP 16: $C_{15}H_{31}$
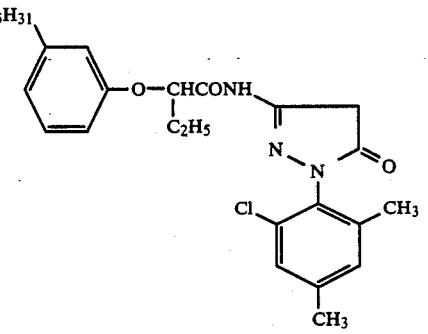
PP 17: t-$C_4H_9$CONH
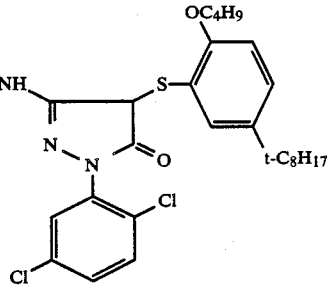
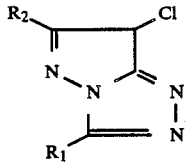
PP 18: $R_1$ = $-(CH_2)_3-$
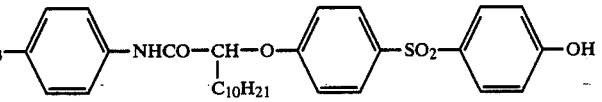
$R_2$ = $-CH_3$
PP 19: $R_1$ = $-(CH_2)_3-$
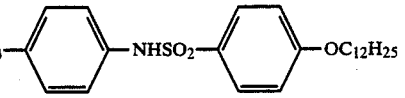
$R_2$ = $-CH_3$
PP 20: $R_1$ =
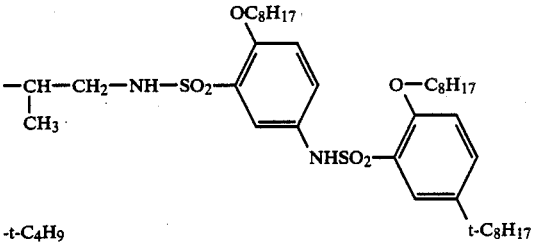
$R_2$ = -t-$C_4H_9$
PP 21: $R_1$ = $-(CH_2)_3-$
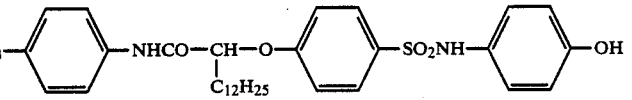
$R_2$ = $-CH_3$
PP 22: $C_{18}H_{37}-N(CH_3)-SO_2-$
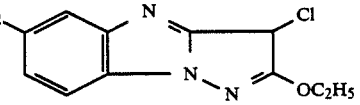
Colour couplers for producing the yellow partial colour image are generally couplers containing an open chain keto methylene group, in particular couplers of the α-acylacetamide series. Suitable examples of these are α-benzoylacetanilide couplers and α-pivaloylacetanilide couplers corresponding to the following formulae:
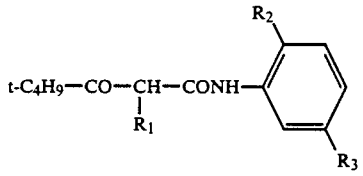
GB 1:
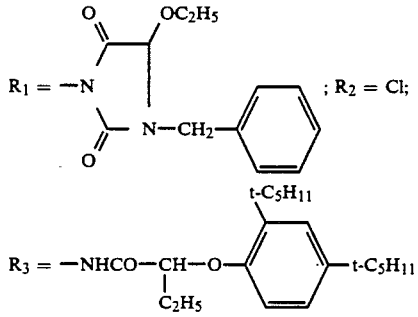
GB 2:
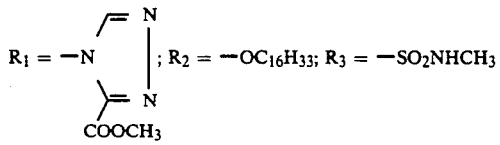
GB 3:
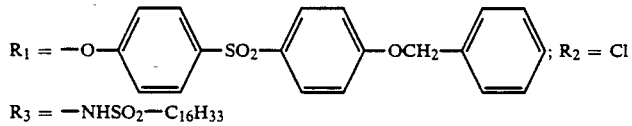
GB 4:
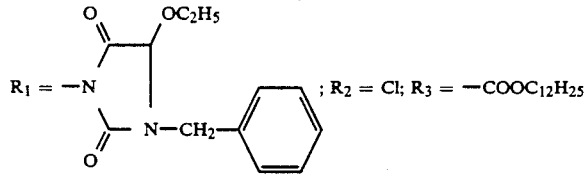
GB 5:
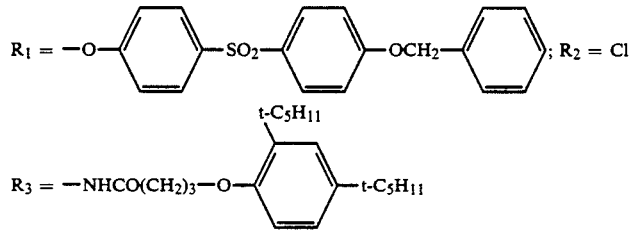
GB 6:
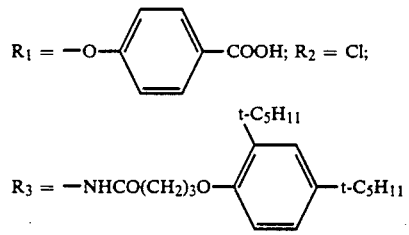

-continued
GB 7:
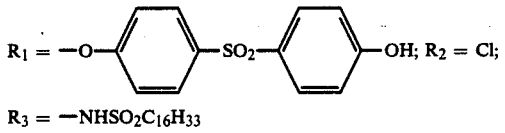
$R_1 = -O-C_6H_4-SO_2-C_6H_4-OH$; $R_2 = Cl$;
$R_3 = -NHSO_2C_{16}H_{33}$
GB 8:
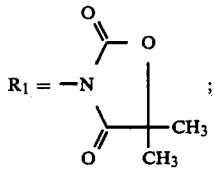
$R_1 = -N$ ; $R_2 = Cl$;
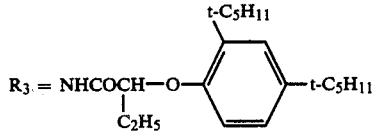
$R_3 = NHCOCH(C_2H_5)-O-C_6H_4-(t\text{-}C_5H_{11})-t\text{-}C_5H_{11}$
GB 9:
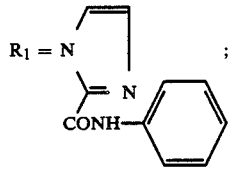
$R_1 = N$ ; $R_2 = OC_{16}H_{33}$;
$R_3 = -SO_2NHCOC_2H_5$
GB 10:
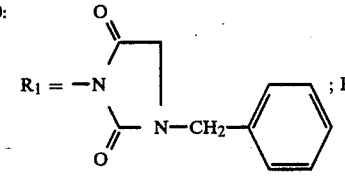
$R_1 = -N$ ; $R_2 = Cl$;
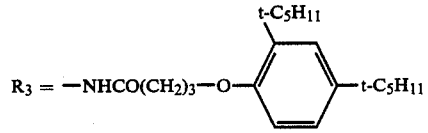
$R_3 = -NHCO(CH_2)_3-O-C_6H_4-(t\text{-}C_5H_{11})-t\text{-}C_5H_{11}$
GB 11:
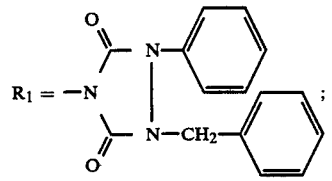
$R_1 = -N$ ; $R_2 = Cl$;
$R_3 = -COOCH(C_4H_9)-COOC_{12}H_{25}$
GB 12:
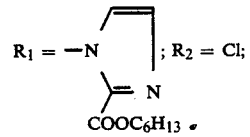
$R_1 = -N$ ; $R_2 = Cl$;
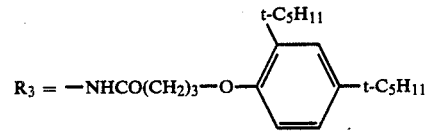
$R_3 = -NHCO(CH_2)_3-O-C_6H_4-(t\text{-}C_5H_{11})-t\text{-}C_5H_{11}$ -continued
GB 13:
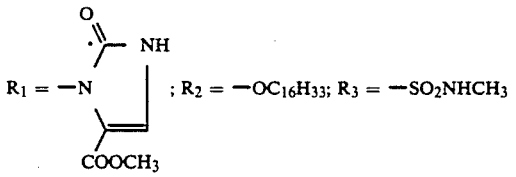
; $R_2$ = —$OC_{16}H_{33}$; $R_3$ = —$SO_2NHCH_3$
GB 14:
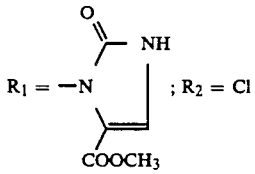
; $R_2$ = Cl
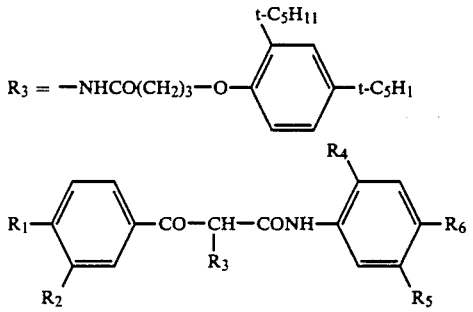
GB 15: $R_1$, $R_3$, $R_5$, $R_6$ = H; $R_4$ = —$OCH_3$;
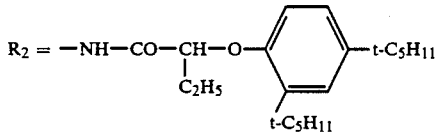
GB 16: $R_2$, $R_6$ = H; $R_1$ = —$OC_{16}H_{33}$; $R_4$, $R_5$ = —$OCH_3$;
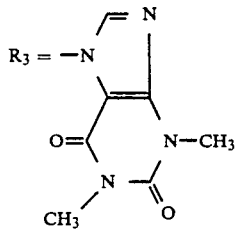
GB 17: $R_2$, $R_6$ = H; $R_1$ = —$OCH_3$, $R_4$ = Cl; $R_5$ = —$COOC_{12}H_{25}$;
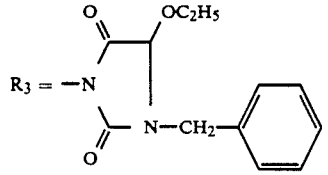
GB 18: $R_2$ = H; $R_1$ = —$OC_{16}H_{33}$; $R_4$ = Cl; $R_5$, $R_6$ = —$OCH_3$;
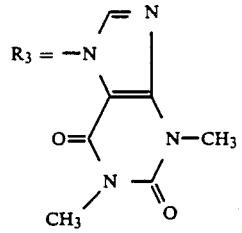
GB 19: $R_2$, $R_5$ = H; $R_1$ = —$OC_{16}H_{33}$; $R_4$ = —$OCH_3$;

-continued

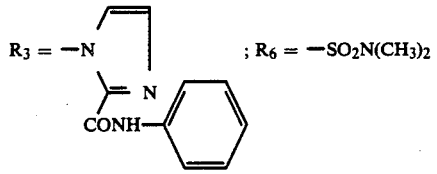

GB 20: $R_2$, $R_6$ = H; $R_1$, $R_4$ = —$OCH_3$;

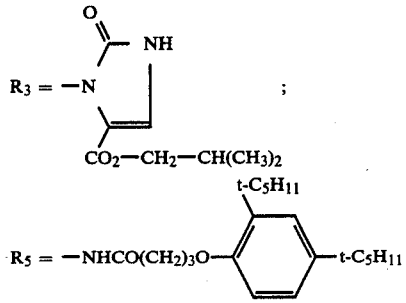

GB 21:

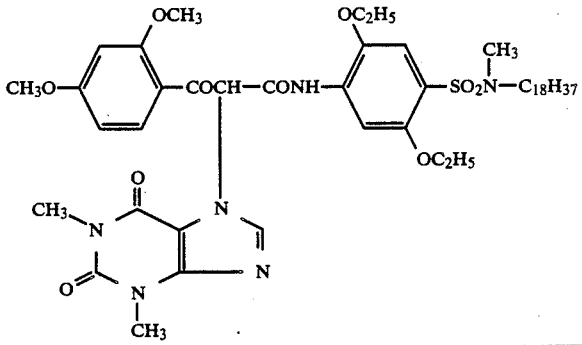

The colour couplers may be 4-equivalent couplers or 2-equivalent couplers. The latter are derived from 4-equivalent couplers in that they contain, in the coupling position, a substituent which is split off in the coupling reaction. The 2-equivalent couplers include couplers which are colourless as well as couplers which have an intense colour of their own which disappears in the process of colour coupling to be replaced by the colour of the image dye produced (masking couplers) and white couplers which give rise to substantially colourless products in their reaction with colour developer oxidation products. Also to be included among 2.equivalent couplers are those couplers which carry, in the coupling position, a removable group which is released in the reaction with colour developer oxidation products to develop a particular photographic activity required, e.g. as development inhibitor or accelerator, either directly or after one or more further groups have been split off from the group originally released (e.g. DE-A-27 03-145, DE-A-28 55 697, DE-A-31 05 026 and DE-A-33 19 428). The known DIR couplers as well as DAR couplers and FAR couplers are examples of such 2-equivalent couplers.

The following are examples of white couplers:

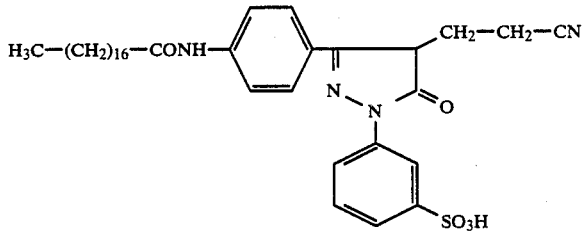

-continued
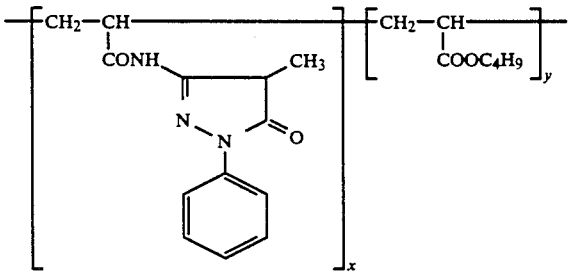
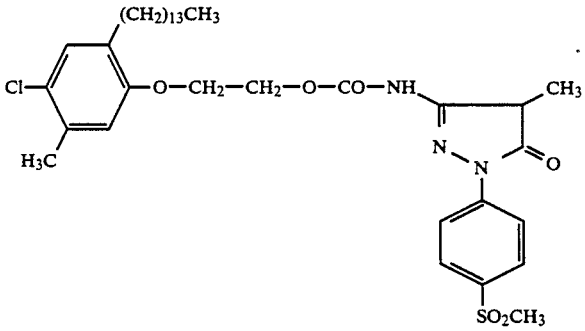
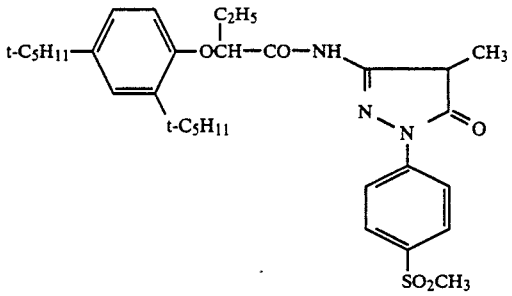
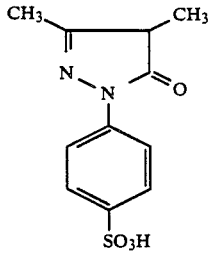
The following are examples of masking couplers:
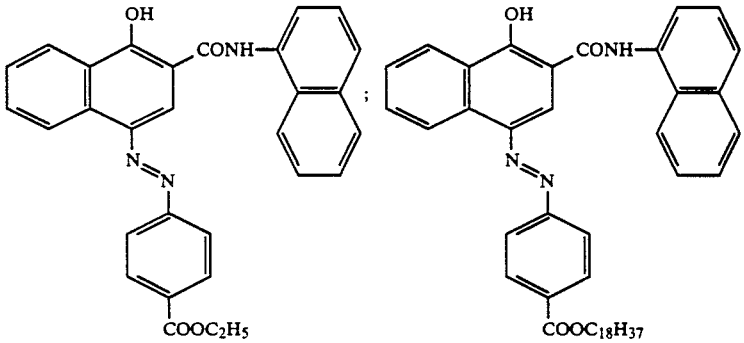

-continued
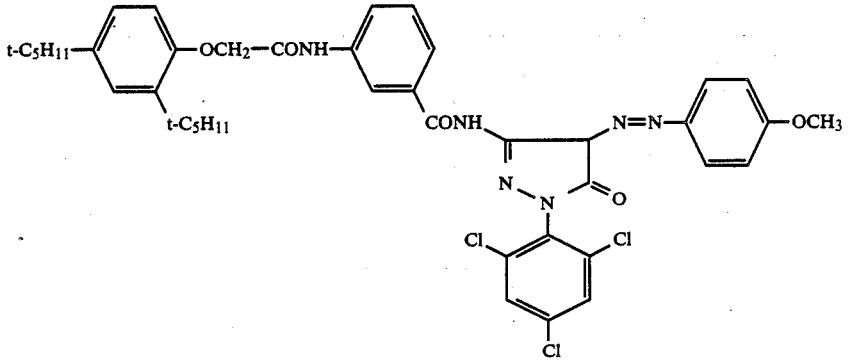
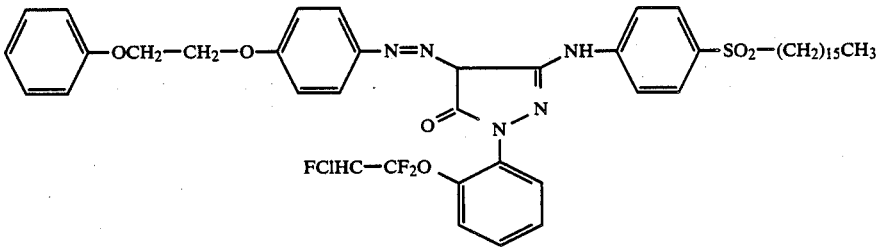
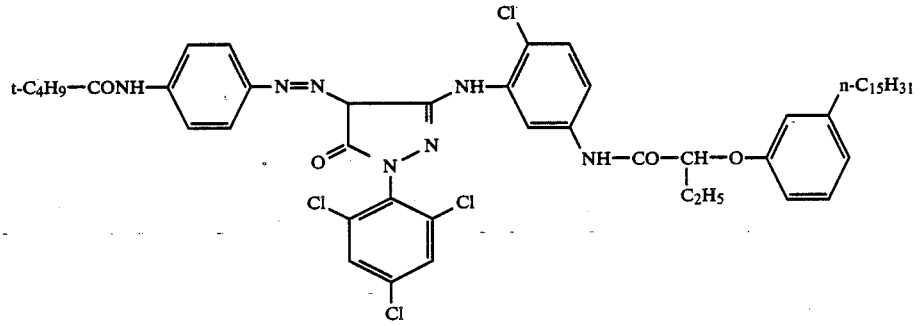
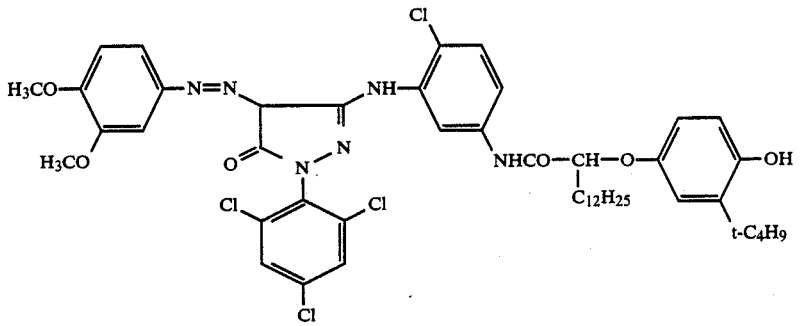
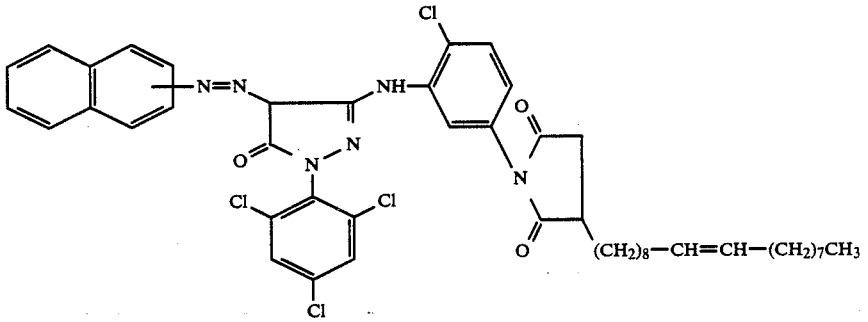

-continued
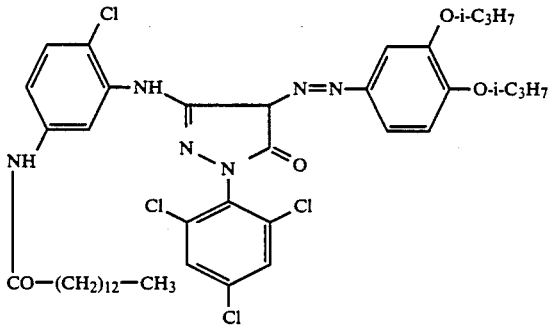
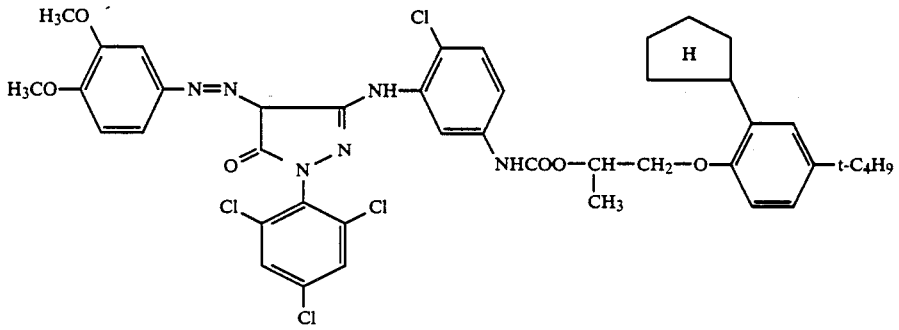
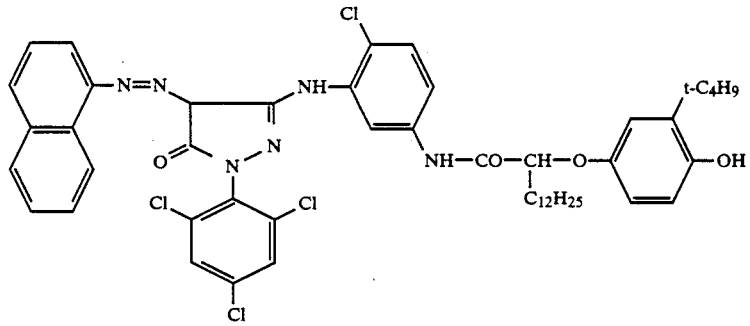
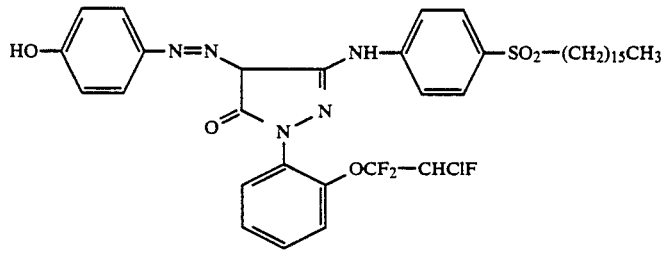
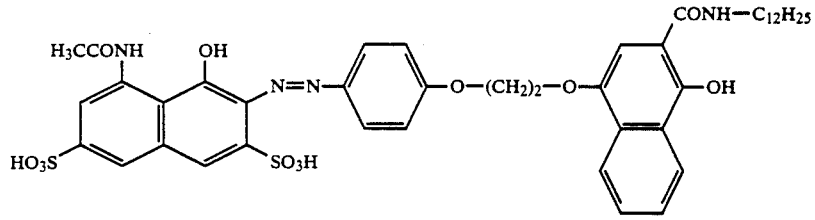

-continued

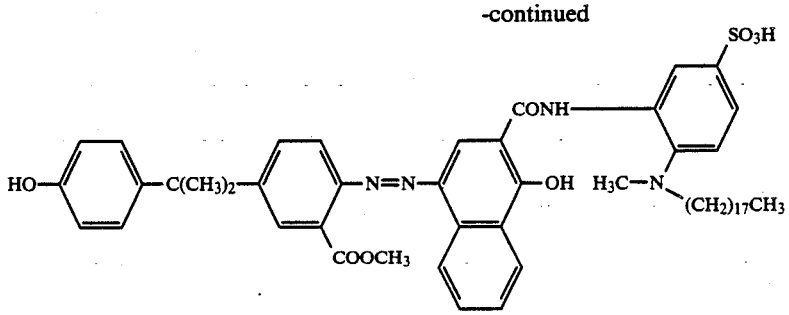

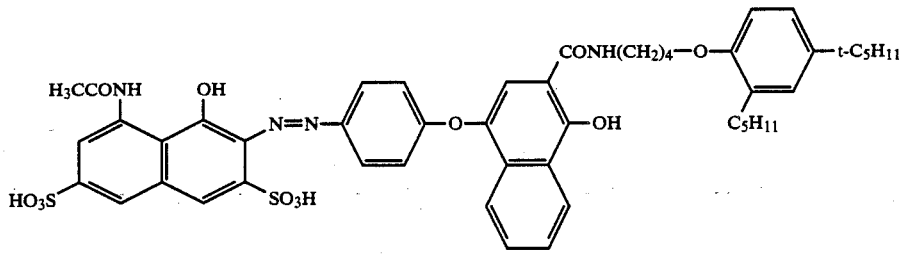

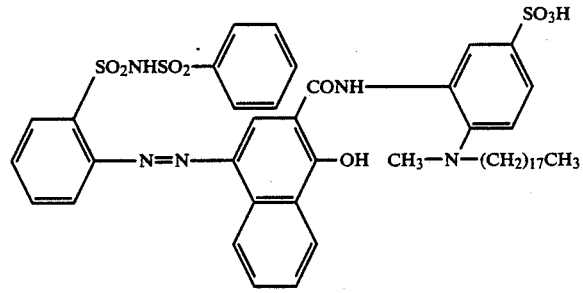

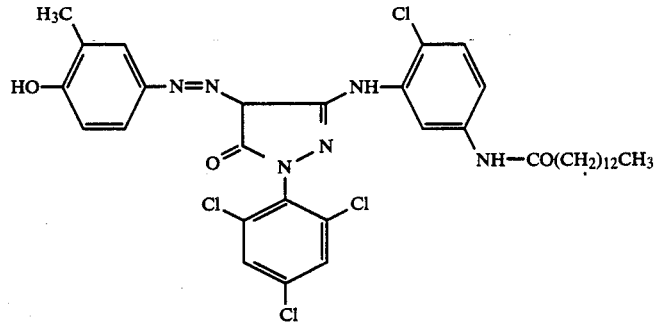

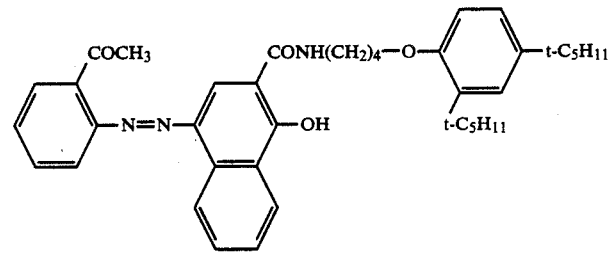

DIR couplers which release development inhibitors of the axole series such as triazoles and benzotriazoles are described in DE-A-2 414 006, 2 610 546, 2 659 417, 2 754 281, 2 726 180, 3 626 219, 3 630 564, 3 636 824, 3 644 416 and 2 842 063. Other advantages for colour reproduction, i.e. colour separation and colour purity, and for reproduction of detail, i.e. sharpness and graininess, may be achieved with DIR couplers of the type which e.g. do not release the development inhibitor directly as a consequence of the coupling reaction with an oxidized colour developer but only after a secondary reaction, for example with a time control group. Examples of these are described in DE-A-28 55 697, 32 99 671, 38 18 231, 35 18 797, EP-A-157 146 and 204 175. US-A-4 146 396 and 4 438 393 and GB-A-2 072 363.

DIR couplers which release a development inhibitor which is decomposed to substantially photographically inactive products in the developer bath are described, for example, in DE-A-32 09 486 and in EP-A-167 168 and 219 713. Trouble-free development and constancy of processing are obtained by means of such couplers.

By using suitable measures in the process of optical sensitization, improvements in the colour reproduction, e.g. a more highly differentiated colour reproduction, may be obtained with DIR couplers, in particular those which split off a readily diffusible development inhibitor. This is described, for example, in EP-A.115 304 and 167 173, GB-A 2 165 058, DE-A.3 700 419 and US-A-4 707 436.

The DIR couplers may be added to various layers in a multilayered photographic material, e.g. to lightinsensitive or interlayers, but they are preferably added to the light-sensitive silver halide emulsion layers, the photographic properties then obtained being influenced by the characteristic properties of the silver halide emulsion, e.g. its iodide content, the structure of the silver halide grains or the grain size distribution. The influence of the inhibitors released may be limited, for example, by the incorporation of an inhibitor acceptor layer according to DE-A-24 31 223. For reasons of reactivity or stability, it may be advantageous to use a DIR coupler which gives rise to a different colour in the coupling reaction from that which is to be produced in the layer containing this coupler.

DAR couplers and FAR couplers which split off a development accelerator or a foggant are particularly suitable for increasing the sensitivity, contrast and maximum density. Compounds of this type are described, for example, in DE-A.2 534 466, 3 209 110, 3 333 355, 3 410 616, 3 429 545 and 3 441 823, in EP-A-89 834, 110 511, 118 087 and 147 765 and in US-A-4 618 572 and 4 656 123.

For an example of the use of DAR couplers, see EP-A-193 389.

It may be advantageous to modify the action of a photographically active group split off from a coupler by causing this group to undergo an intermolecular reaction with another group after it has been released, as described in DE-A-3 506 805.

The following are examples of such couplers:

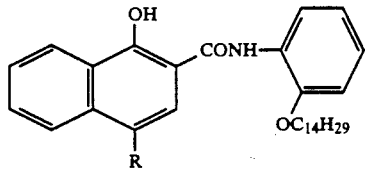

DIR 1

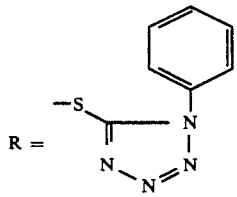

DIR 2

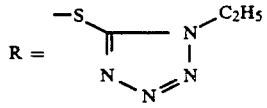

DIR 3

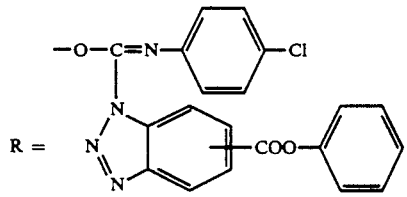

DIR 4

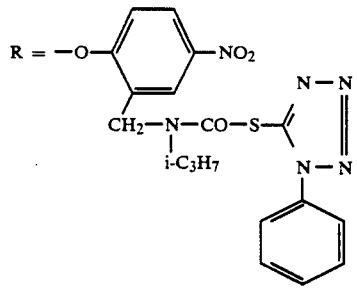

-continued
DIR 5
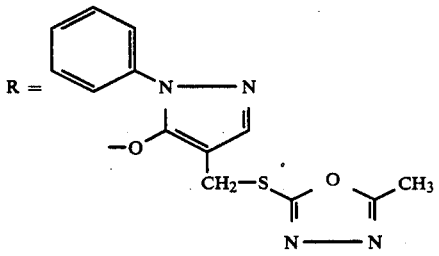
DIR 6
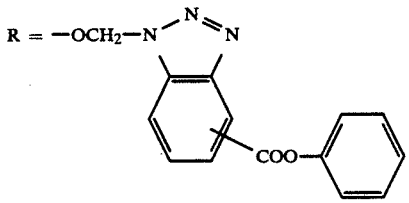
DIR 7
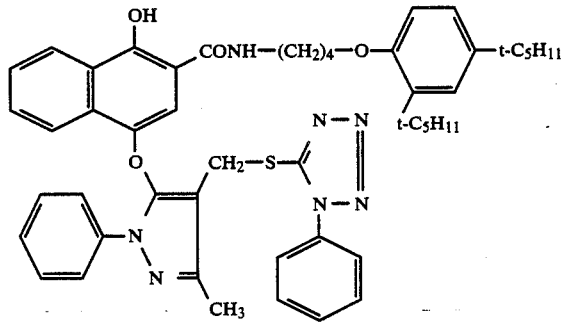
DIR 8
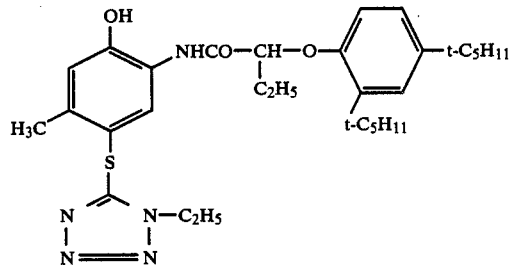
DIR 9
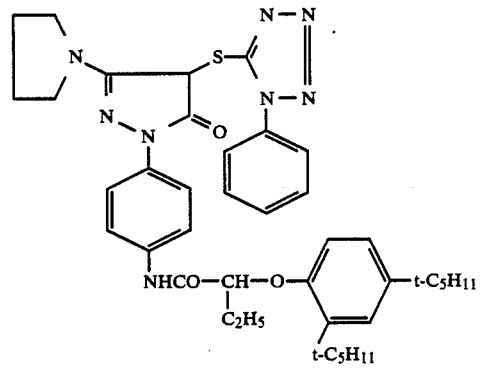

-continued
DIR 10
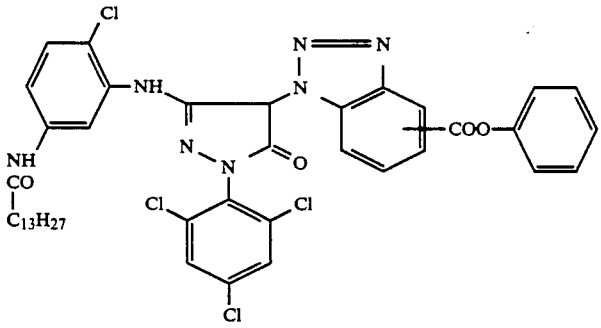
DIR 11
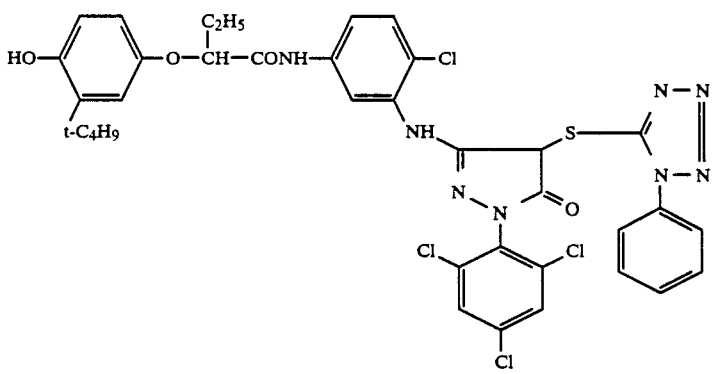
DIR 12
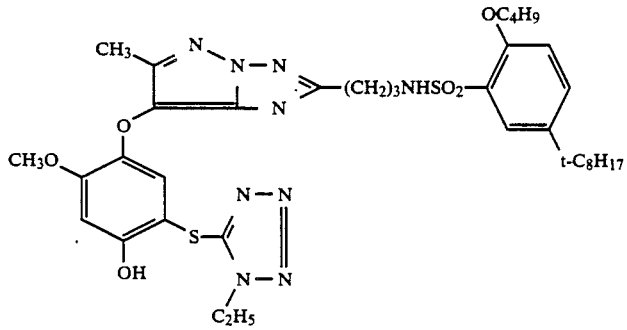
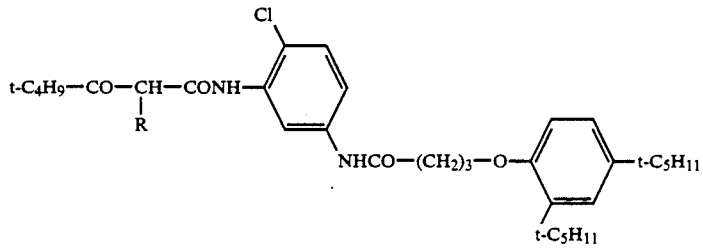
DIR 13
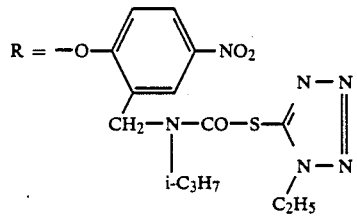

-continued
DIR 14
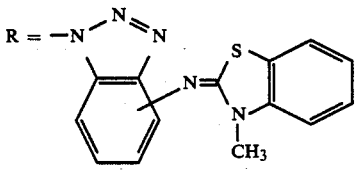
DIR 15
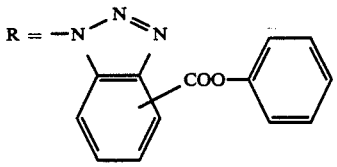
DIR 16
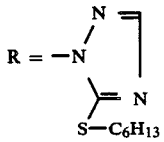
DIR 17
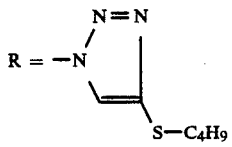
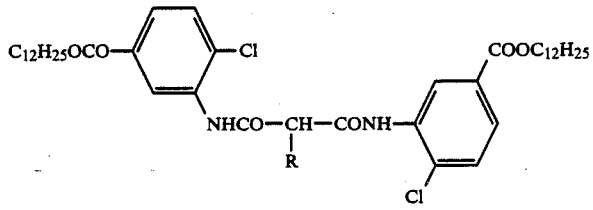
DIR 18
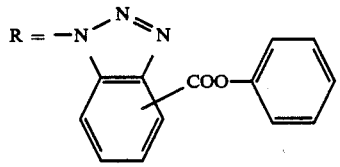
DIR 19
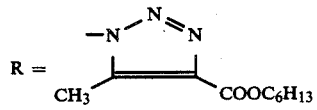
DIR 20
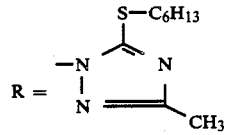
DIR 21
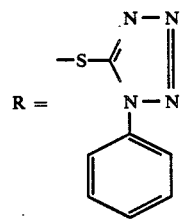

-continued
DIR 22
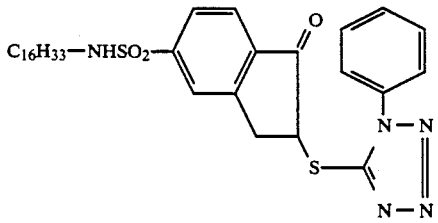
DIR 23
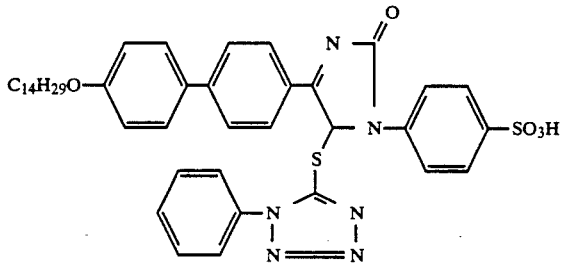
DIR 24
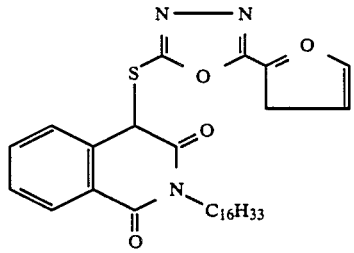
Examples of DAR couplers:
DAR 1
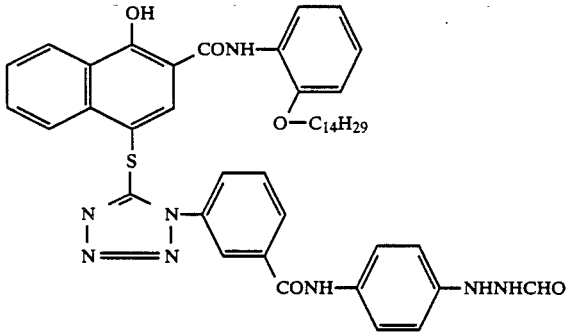
DAR 2
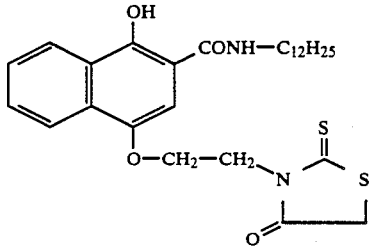

-continued

DAR 3

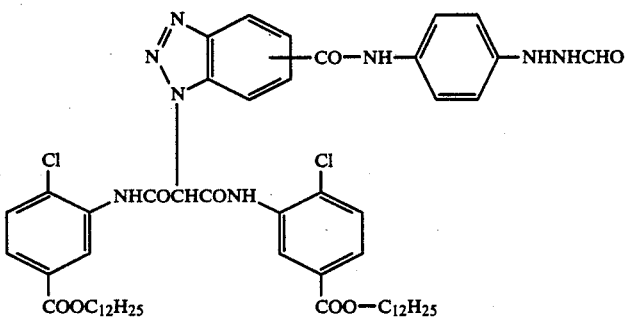

Since DIR, DAR and FAR couplers are used mainly for the activity of the group released in the coupling reaction and the colour producing properties of these couplers is less important, DIR, DAR and FAR couplers which give rise to mainly colourless products in the coupling reaction are also suitable (DE-A-1 547 640).

The group which is split off may also be a ballast group so that the reaction with colour developer oxidation products gives rise to coupling products which are diffusible or at least have a weak or limited mobility (US-A-4 420 556).

The material may also contain compounds other than couplers capable of releasing, for example, a development inhibitor, a development accelerator, a bleaching accelerator, a developer, a silver halide solvent, a foggant or an anti-foggant. Examples are the so-called DAR hydroquinones and other compounds described, for example, in US-A-4 636 546, 4 345 024 and 4 684 604, in DE-A-3 145 640, 2 515 213 and 2 447 079 and in EP-A-198 438. These compounds fulfil the same function as DIR, DAR or FAR couplers except that they do not give rise to coupling products.

High molecular weight colour couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284 and US-A-4 080 211. The high molecular weight colour couplers are generally prepared by polymerisation of ethylenically unsaturated monomeric colour couplers. They may also be obtained by polyaddition or polycondensation. The polyester carboxylates according to the invention may be used as emulsifiers for their preparation.

The incorporation of the couplers or other compounds in silver halide emulsion layers may be carried out by first preparing a solution, dispersion or emulsion of the particular compound and then adding this to the casting solution for the layer in which it is to be introduced. The choice of suitable solvents or dispersing agents depends on the solubility of the compound.

Methods for introducing substantially water-insoluble compounds by grinding are described, for example, in DE-A-2 609 741 and DE-A-2 609 742.

Hydrophobic compounds may also be introduced into the casting solution by means of high boiling solvents, so-called oil formers. Suitable methods are described, for example, in US-A-2 322 027, US-A-2 801 170, US-A-2 801 171 and EP-A-0 043 037.

Oligomeric or polymeric compounds known as so-called polymeric oil formers may be used instead of the high boiling solvents.

The compounds may also be introduced into the casting solution in the form of charged latices: see, for example, DE-A-2 541 230, DE-A-2 541 274, DE-A-2 835 856, EP-A-4 291 113.

Cationic polymers, so-called mordanting polymers, may also be used for incorporating anionic, water-soluble compounds (e.g. dyes)in a diffusion-fast form.

The following are examples of suitable oil formers: Phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

The following are examples of suitable oil formers: Dibutylphthalate, dicyclohexylphthalate, di-2-ethylhexyl phthalate, decyl phthalate, triphenylphosphate, tricresyl phosphate, 2-ethylhexyldiphenylphosphate, tricyclohexylphosphate, tri-2-ethylhexylphosphate, tridecylphosphate, tributoxyethylphosphate, trichloropropylphosphate, di-2-ethylhexylphenylphosphate, 2-ethylhexylbenzoate, dodecylbenzoate, 2-ethylhexyl-p-hydroxybenzoate, diethyl dodecanamide, N-tetradecylpyrrolidone, isostearyl alcohol, 2,4-di-tert.-amylphenol, dioctylacetate, glycerol tributyrate, isostearyl lactate, trioctyl citrate, N,N-dibutyl-2butoxy-5-tert.-octyl aniline, paraffin, dodecylbenzene and diisopropylnaphthalene.

The polyester carboxylic acids according to the invention are preferably used as oil formers, optionally together with other oil formers but the compounds according to the invention should amount to at least 50% by weight.

Each of the differently sensitized light-sensitive layers may consist of a single layer or comprise two or more silver halide emulsion partial layers (DE-C-1 121 470). Red-sensitive silver halide emulsions are frequently arranged closer to the layer support than green-sensitive silver halide emulsion layers, which in turn are arranged closer to the support than blue-sensitive layers, and a light-insensitive yellow filter layer is generally arranged between the green-sensitive layers and the blue-sensitive layers.

If the intrinsic sensitivity of the green-sensitive layers or red-sensitive layers is sufficiently low, the yellow filter layer may be omitted and other layer arrangements may be used in which, for example, the blue-sensitive layers may be placed on the support, followed by the red-sensitive layers and finally the green-sensitive layers.

The light-insensitive interlayers generally arranged between layers differing in their spectral sensitivity may contain substances which prevent accidental diffusion of developer oxidation products from one light-sensitive layer into another light-sensitive layer of a different spectral sensitization.

Suitable substances, also known as scavengers or EOP acceptors, are described in Research Disclosure 17643/1978, Chapter VII, 17842/1979, pages 94 to 97 and 18716/1979, pages 650 and in EP-A-69 070, 98072, 124877 and 125 522 and in US-A-463 226.

The following are examples of particularly suitable compounds:

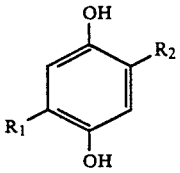

$R_1, R_2$ = -t-$C_8H_{17}$

-sec-$C_{12}H_{25}$

-t-$C_6H_{13}$ $-C(CH_3)_2-(CH_2)_3-COO$-n-$C_6H_{13}$

-sec-$C_8H_{17}$ $-C_{15}H_{31}$

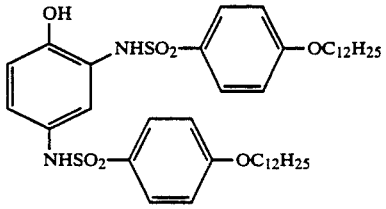

When a material contains several partial layers of the same spectral sensitization, these may differ in their composition, in particular in the nature and quantity of the silver halide grains. The partial layer of higher sensitivity is generally arranged further away from the support than the partial layer of lower sensitivity. Partial layers having the same spectral sensitization may be adjacent to one another or separated by other layers, e.g. by layers of a different spectral sensitization. Thus, for example, all highly sensitive layers may be combined to form a layer packet and all low sensitivity layers may be combined to form another layer packet (DE-A 1 958 709, DE-A 2 530 645, DE-A 2 622 922).

The photographic material may also contain UV light absorbent compounds, white toners, spacers, filter dyes, formalin acceptors, light-protective agents, antioxidants, $D_{min}$ dyes, additives for improving the stabilization of the dyes, coupers and whites and substances for reducing the colour fog, etc.

UV light absorbent compounds are required on the one hand to protect the image dyes against bleaching by daylight rich in UV light and on the other hand as filter dyes for absorbing the UV light present in the daylight used for exposure, thereby improving the colour reproduction of a film. The compounds used for the two different purposes normally differ in structure. Examples include aryl-substituted benzotriazole compounds (US-A 3 533 794), 4-thiazolidone compounds (US-A 3 314 794 and 3 352 681), benzophenone compounds (JP-A 2784/71), cinnamic acid ester compounds (US-A 3 705 805 and 3 707 375), butadiene compounds (US-A 4 045 229) and benzoxazole compounds (US-A 3 700 455.

The following are examples of particularly suitable compounds:

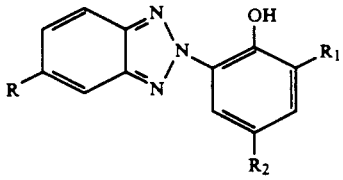

R, $R_1$ = H; $R_2$ = t-$C_4H_9$ (UV1)

R = H; $R_1$, $R_2$ = t-$C_4H_9$ (UV2)

R = H; $R_1$, $R_2$ = t-$C_5H_{11}$-tert. (UV3)

R = H; $R_1$ = sec-$C_4H_9$; $R_2$ = t-$C_4H_9$ (UV4)

R = Cl; $R_1$ = t-$C_4H_9$; $R_2$ = sec-$C_4H_9$ (UV5)

R = Cl; $R_1$, $R_2$ = t-$C_4H_9$ (UV6)

R = Cl; $R_1$ = t-$C_4H_9$-tert.; $R_2$ = $-CH_2-CH_2-COOC_8H_{17}$ (UV7)

R = H: R = iso-$C_{12}H_{25}$: $R_2$ = $CH_3$ (UV8)

R, $R_1$, $R_2$ = t-$C_4H_9$ (UV9)

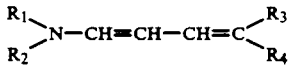

$R_1$, $R_2$ = n-$C_6H_{13}$; $R_3$, $R_4$ = CN (UV10)

(UV11)

$R_1$, $R_2$ = $C_2H_5$; $R_3$ = $-SO_2-$ 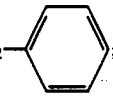 ; $R_4$ = $COOC_8H_{17}$ (UV12)

$R_1$, R = $C_2H_5$; $R_3$ = $-SO_2-$ 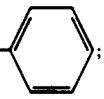 ; $R_4$ = $COOC_{12}H_{25}$ $R_1$, $R_2$ = $CH_2{=}CH-CH_2$; $R_3$, $R_4$ = CN (UV13)

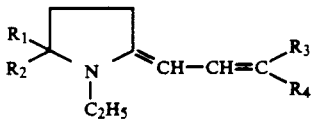

$R_1$, $R_2$ = H; $R_3$ = CN; $R_4$ = $CO-NHC_{12}H_{25}$ (UV14)

$R_1$, $R_2$ = $CH_3$; $R_3$ = CN; $R_4$ = $CO-NHC_{12}H_{25}$ (UV15)

(UV16)

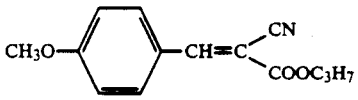

Ultraviolet absorbent couplers (such as cyan couplers of the α-naphthol series) and ultraviolet absorbent polymers may also be used. These ultraviolet absorbents may be fixed in a particular layer by mordanting.

Filter dyes suitable for visible light include oxonole dyes, hemioxonole dyes, styryl dyes, merocyanine dyes, cyanine dyes and azo dyes. Among these dyes, oxonole dyes, hemioxonole dyes and merocyanine dyes are particularly advantageous.

Suitable white toners are described e.g. in Research Disclosure 17643, December 1978, Chapter V, pages 22 et seq and in US-A-2 632 701 and 3 269 840 and GB-A-852 075 and 1 319 763.

Certain layers of binder, especially those furthest away from the support but occasionally also interlayers, particularly if they constitute the layer furthest from the support in the course of preparation of the material, may contain photographically inert particles of an inorganic or organic nature, e.g. as matting agents or as spacers (DE-A 3 331 542, DE-A 3 424 893, Research Disclosure No.17643, December 1978, Chapter XVI, pages 22 et seq).

The average particle diameter of the spacers is mainly in the range of from 0.2 to 10 μm. The spacers are insoluble in water and may be soluble or insoluble in alkalis. Those which are soluble in alkalies are generally removed from the photographic material in the alkaline development bath. Examples of suitable polymers include polymethyl methacrylate, copolymers of acrylic acid and methyl methacrylate and hydroxypropylmethyl cellulose hexahydrophthalate.

The following are examples of suitable formalin acceptors:

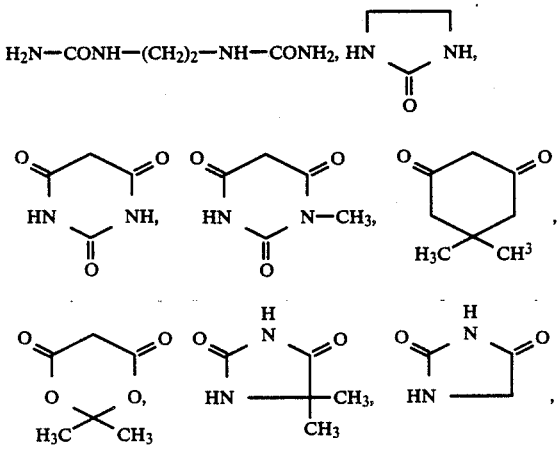

-continued

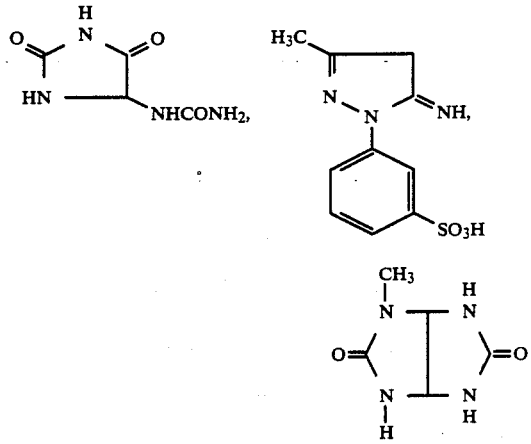

Additives for improving the stability of the dyes, couplers and whites and for reducing colour fog (Research Disclosure 17643/1978, Chapter VII) may belong to the following classes of chemical compounds: Hydroquinones, 6-hydroxychromans, 5-hydroxycoumarans, spirochromans, spiroindans, p-alkoxyphenols, sterically hindered phenols, gallic acid derivatives, methylene dihydroxybenzenes, aminophenols, sterically hindered amines, derivatives with esterified or etherified phenolic hydroxyl groups, and metal complexes.

Compounds containing both a sterically hindered amine partial structure and a sterically hindered phenol partial structure in one and the same molecule (US-A-4 268 593) are particularly effective in preventing any impairment (deterioration or degradation) to yellow colour images as a result of the development of heat, moisture or light. Spiraindans (JP-A-159 644/81) and chromans substituted by hydroquinone diethers or monoethers (JP-A-89 835/80) are particularly effective in preventing impairment (deterioration or degradation) to magenta colour images. particularly any impairment (deterioration or degradation) due to the action of light.

The following are examples of particularly suitable compounds:

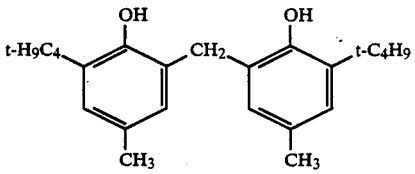

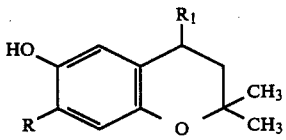

R = t-$C_8H_{17}$; $R_1$ = $CH_3$
R = n-$C_8H_{17}$; $R_1$ = i-$C_3H_7$

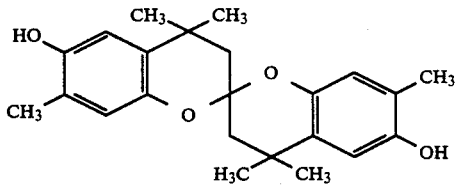

-continued

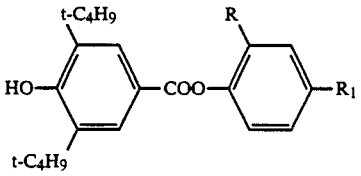

R, $R_1$ = t-$C_4H_9$
R, $R_1$ = t-$C_5H_{11}$

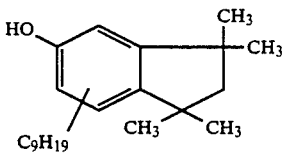

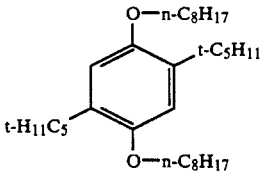

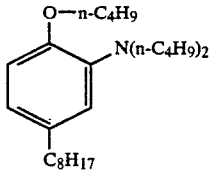

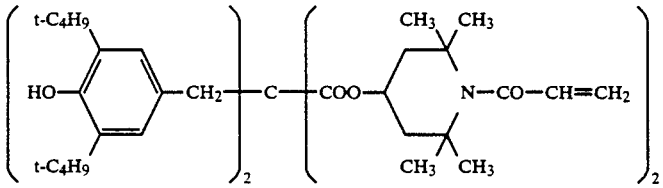

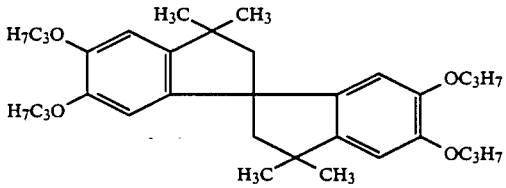

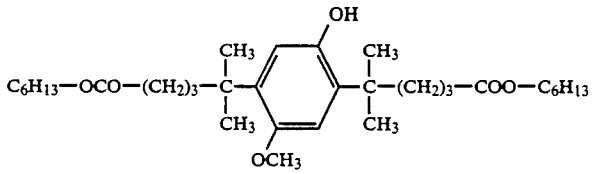

and the compounds mentioned as EOP acceptors.

The layers of the photographic material may be hardened with conventional hardeners, e.g. with formaldehyde, glutaraldehyde or similar aldehyde compounds, diacetyl, cyclopentadione and similar ketone compounds, bis-(2-chloroethylurea). 2-hydroxy-4,6-dichloro-1,3,5-triazine and other compounds containing reactive halogen (US-A 3 288 775, US-A-2 732 303, GB-A-974 723 and GB-A-167 207), divinylsulphone compounds, 5-acetyl-1,3-diacryloyl hexahydro1,3,5-triazine and other compounds containing a reactive olefine bond (US-A-3 635 718, US-A-3 232 763 and GB-A994 869): N-hydroxymethylphthalimide and other N-methylol compounds (US-A-2 73,2 316 and US-A-2 586 168): isocyanates (US-A-3 103 437): aziridine compounds (US-A-3 017 280 and US-A-2 983 611): acid derivatives (US-A-2 725 294 and US-A-2 725 295): compounds of the carbodiimide type (US-A-3 100 704); carbamoyl pyridinium salts (DE-A-2 225 230 and DE-A-2 439 551); carbamoyloxypyridinium compounds (DE-A-2 408 814); compounds containing a phosphorus-halogen bond (JP-A-113 929/83); N-carbonyloximide compounds (J-A-43353/81); N-sulphonyloximido compounds (US-A-4 111 926), dihydroquinoline compounds (US-A-4 013 468), 2-sulphonyloxy pyridinium salts (JP-A-110 762/81), formamidinium salts (EP-A-0 162 308), compounds containing two or more N-acyloximino groups (US-A-4 052 373), epoxy compounds (US-A-3 091 537), compounds of the isoxazole type (US-A-3 321 313 and US-A-3 543 292): halogenated carboxyaldehydes such as mucochloric acid: dioxane derivatives such as dihydroxydioxane and dichlorodioxane: and inorganic hardeners such as chrome alum and zirconium sulphate.

Hardening may be brought about in known manner by adding the hardener to the casting solution for the layer which is to be hardened or by coating this layer with a layer containing a diffusible hardener.

The classes of compounds mentioned above include both slow acting hardeners and quick acting hardeners as well as so-called instant hardeners, which are particularly advantageous. Instant hardeners are compounds which effect cross-linking of suitable binders at such a rate that hardening is completed to such an extent immediately after casting or at the latest after 24 hours, preferably after not more than 8 hours, that no further change in sensitometry and swelling of the combination of layers occurs as a result of the cross-linking reaction. The swelling is taken to be the difference between the wet layer thickness and the dry layer thickness of a film processed under aqueous conditions (Photogr. Sci., Eng. 8 (1964), 275: Photogr. Sci., Eng. (1972), 449).

These hardeners which react very rapidly with gelatine may be, for example, carbamoyl pyridinium salts which are capable of reacting with free carboxyl groups of gelatine so that the latter react with free amino groups of gelatine to form peptide bonds and bring about crosslinking of the gelatine.

Compounds corresponding to the following general formulae are examples of suitable instant hardeners:

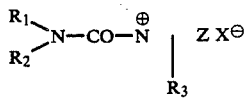

(a)

wherein $R_1$ denotes alkyl, aryl or aralkyl, $R_2$ has the same meaning as $R_1$ or denotes alkylene, arylene, aralkylene or alkaralkylene, the second bond being linked to a group of the following formula:

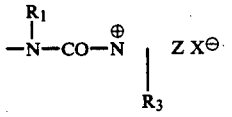

$R_1$ and $R_2$ together denote the atoms required for completing an optionally substituted heterocyclic ring, for example a piperidine, piperazine or morpholine ring, which ring may be substituted, e.g. by $C_1$–$C_3$-alkyl or by halogen, $R_3$ denotes hydrogen, alkyl, aryl, alkoxy, $NR_4$—$COR_5$, $(CH_2)_m$—$NR_8R_9$, $(CH_2)_n$—$CONR_{13}R_{14}$ or

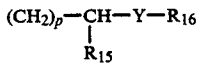

0 20 or a bridging member or a direct link to a polymer chain, in which $R_4$, $R_6$, $R_7$, $R_9$, $R_{14}$, $R_{15}$, $R_{17}$, $R_{18}$ and $R_{19}$ denote hydrogen or $C_1$–$C_4$-alkyl, $R_5$ denotes hydrogen, $C_1$–$C_4$-alkyl or $NR_6R_7$, $R_8$ denotes $COR_{10}$, $R_{10}$ denotes $NR_{11}R_{12}$, $R_{11}$ denotes $C_1$–$C_4$-alkyl or aryl, in particular phenyl, $R_{12}$ denotes hydrogen, $C_1$–$C_4$-alkyl or aryl, in particular phenyl, $R_{13}$ denotes hydrogen, $C_1$–$C_4$-alkyl or aryl, in particular phenyl, $R_{16}$ denotes hydrogen, $C_1$–$C_4$-alkyl, $COR_{18}$ or $CONHR_{19}$, m denotes a number from 1 to 3, n denotes a number from 0 to 3, p denotes a number from 2 to 3 and Y denotes 0 or $NR_{17}$ or $R_{13}$ and $R_{14}$ together denote the atoms required for completing an optionally substituted heterocyclic ring, for example a piperidine, piperazine or morpholine ring, which ring may be substituted, e.g. by $C_1$–$C_3$-alkyl or by halogen, Z denotes the carbon atoms required for completing a 5-membered or 6-membered aromatic heterocyclic ring optionally containing a condensed benzene ring and $X^{\ominus}$ denotes an anion, which is absent if an anionic group is already attached to the remainder of the molecule:

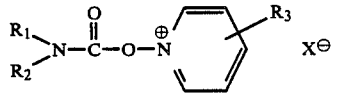

(b)

wherein $R_1$, $R_2$, $R_3$ and $X^{\ominus}$ have the meanings indicated for formula (a).

Some hardeners are diffusible and have an equal hardening action on all the layers within a combination of layers while others, including both low molecular weight and high molecular weight hardeners, are non-diffusible and their action is confined to the layer in which they are contained. These non-diffusible hardeners may be used for particularly powerful cross-linking of individual layers, e.g. the protective layer. This is important when the silver halide layer is hardened only to a slight extent for the purpose of increasing the silver covering power and the mechanical properties are required to be improved by means of the protective layer (EP-A.0 114 699).

Colour photographic negative materials are conventionally processed by development, bleaching, fixing and washing or by development, bleaching, fixing and stabilizing without washing. Bleaching and fixing may be combined in a single process step. The colour developer compounds used may be any developer compounds which are capable, in the form of their oxidation products, of reacting with colour couplers to form azomethine or indophenol dyes. Suitable colour developer compounds include aromatic compounds of the p-phenylenediamine series containing at least one primary amino group, e.g. N,N-dialkyl-p-phenylenediamines such as N,N-diethyl-p-phenylenediamine, 1-(N-ethyl-N-methane-sulphonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Other suitable colour developers are described, for example, in J.Amer. Chem. Soc. 73, 3106 (1951) and in Modern Photographic Processing, by G.Haist, 1979, John Wiley and Sons, New York, pages 545 et seq.

Colour development may be followed by an acid short stop bath or by washing.

The material is normally bleached and fixed immediately after colour development. Fe(III) salts and Fe(III) complex salts such as ferricyanides, dichromates, and water-soluble cobalt complexes, for example, may be used as bleaching agents. Iron(III) complexes of aminopolycarboxylic acids are particularly preferred, especially e.g. the complexes of ethylene diaminotetracetic acid, propylene diamino tetracetic acid, diethylenetriaminopentacetic acid, nitrilotriacetic acid, iminodiacetic acid, N-hydroxyethyl-ethylenediaminotriacetic acid or alkyliminodicarboxylic acids and the complexes of corresponding phosphonic acids. Persulphates are also suitable bleaching agents.

The bleach fixing bath or fixing bath is generally followed by washing which may be carried out in counterflow or in several tanks each with its own water supply.

Advantageous results may be obtained by finishing with a final bath containing little or no formaldehyde.

Washing may be replaced by a stabilizing bath, which is normally carried out in counter-current. When formaldehyde has been added, this stabilizing bath also performs the function of a final bath.

In colour reversal materials, development is first carried out with a black-and-white developer whose oxidation product is not capable of reacting with colour couplers. This is followed by diffuse second exposure after which the materials are developed with a colour developer, bleached and fixed.

EXAMPLE 1

A mixture of equal parts by weight of the cyan couplers BG 17 and BG 14 was emulsified with the aid of the polyester carboxylic acids according to the invention I-1 and I-2 and, for comparison, with the known oil former, tricresylphosphate. Emulsions E 1 to E 5 were prepared. The ratio of colour coupler to oil former was in all cases 1:1.

E 1 : tricresylphosphate
E 2 : tricresylphosphate/polyester carboxylic acid I-1 (ratio by weight 1 : 1)
E 3 : polyester carboxylic acid I-1
E 4 : tricresylphosphate/polyester carboxylic acid I-2 (ratio by weight 1 : 1)
E 5 : polyester carboxylic acid I-2.

Emulsions E 1 to E 5 were added to various samples of a red-sensitized silver halide emulsion. The silver halide gelatine emulsion consisted of 75 g of silver iodobromide (iodide content 3 mol-%) and 72 g of gelatine, based on 1 kg of emulsion.

The emulsions thus prepared were applied to a cellulose triacetate layer support covered with an adhesive layer and were then dried and hardened. The amount of silver bromide applied was 1.65 g/m$^2$ and the amount of coupler and oil former applied was 1.0 g/m$^2$ each. Hardening was carried out by coating the surface with a 1% by weight solution of the hardener corresponding to the following formula

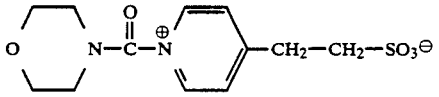

Photographic test:

The individual samples were exposed by means of a sensitometer and then processed with the following colour developer.

| Colour developer | |
|---|---|
| Water dist. | 800 g |
| Disodium salt of hydroxyethane disulphonic acid | 2 g |
| Disodium salt of ethylenedraminotetracetic acid | 2 g |
| Potassium carbonate | 34 g |
| Sodium bicarbonate | 1.55 g |
| Sodium disulphite | 0.28 g |
| Sodium sulphite | 3.46 g |
| Potassium bromide | 1.34 g |
| Hydroxylamine sulphate | 2.4 g |
| N-ethyl-N-(β-hydroxy)-ethyl-4-amino-3-ethyl aniline sulphate | 4.7 g |
| Water dist. up to 1000 ml | |

| Processing | Processing [min] (25° C.) |
|---|---|
| Colour developer | 10 |
| Short stop bath | 4 |
| Intermediate washing | 5 |
| Bleaching bath | 5 |
| Intermediate washing | 5 |
| Fixing bath | 5 |
| Final washing | 10 |

The short stop, bleaching and fixing baths have the conventional compositions of such baths. A final bath free from formalin was used.

The maximum colour density $D_{max}$, $\lambda_{max}$, relative sensitivity, fogging and gradation were determined (Table 3).

TABLE 3

| Emulsion | Fog | Relative sensitivity | Gradation | $D_{max}$ | $\lambda_{max}$ | |
|---|---|---|---|---|---|---|
| E-1 | 0.17 | 100 | 2.1 | 2.04 | 695 | Comparison |
| E-2 | 0.13 | 100 | 2.5 | 2.42 | 694 | according to the invention |
| E-3 | 0.14 | 104 | 3.0 | 2.64 | 693 | according to the invention |
| E-4 | 0.13 | 104 | 2.6 | 2.48 | 695 | according to the invention |
| E-5 | 0.15 | 103 | 2.8 | 2.52 | 693 | according to the invention |

It will be seen from Table 3 that higher maximum colour densities and a steeper gradation are obtained with the polyester carboxylic acids according to the invention.

EXAMPLE 2

The magenta coupler corresponding to the following formula

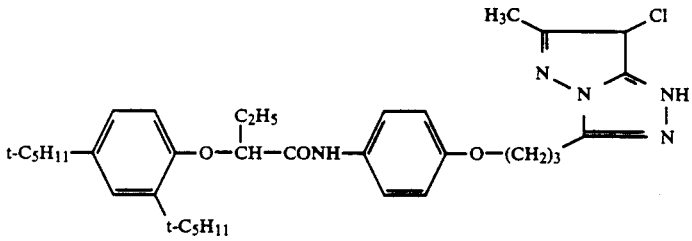

was emulsified with the aid of the polyester carboxylic acids according to the invention I-1 and I-2. Tricresylphosphate was used as comparison. The resulting emulsions E 6 to E 8 had the following compositions:

E 6 : Tricresylphosphate
E 7 : Polyester carboxylic acid I-2
E 8 : Polyester carboxylic acid I-1.

The emulsions were introduced into a green-sensitized silver halide material, processed and hardened as described in Example 1. 1.2 g/m² of silver bromide, 0.85 g/m² of coupler and 0.85 g/m² of oil former were applied.

The fog and the maximum colour density were determined.

TABLE 4

| Emulsion | Fog | maximum colour density | |
|---|---|---|---|
| E 6 | 0.31 | 2.19 | comparison |
| E 7 | 0.25 | 2.50 | according to the invention |
| E 8 | 0:24 | 2.49 | according to the invention |

The results show that an improved fog/colour yield relationship can be obtained when the polyester carboxylic acids according to the invention are used as oil formers.

EXAMPLE 3

0.7 g of Oleyl methyl tauride was dissolved in 136 ml of water under nitrogen and heated to 80° C. 0.57 g of an initiator solution of 2 g of potassium peroxy disulphate in 100 ml of water and at the same time a suspension of 4.5 g of the coupler monomer corresponding to the following formula:

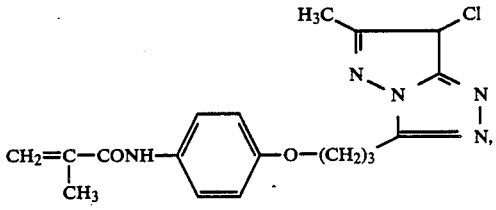

7.5 g of butyl acrylate and 3 g of methacrylamido undecanoic acid in 68 ml of methanol were added to this solution. A further 6.8 ml of initiator solution was added dropwise within one hour and the reaction mixture was then stirred at 80° C for 2 hours. The methanol was then distilled off and the aqueous residue was adjusted to a solids content of 10% by weight. A finely divided latex having a residue of less than 2% by weight was obtained (latex coupler L 1).

Latex couplers L 2, L 3 and L 4 were prepared in similar manner except that 0.7 g, 1.4 g and 2.8 g, respectively, of the sodium salt of polyester carboxylic acid I-2 were used in addition to the oleyl methyl tauride used as emulsifying agent.

The latex couplers L 1 to L 4 were added to various samples of a green-sensitized silver halide emulsion consisting of 75 g of silver iodobromide (iodide content 3 mol-%) and 72 g of gelatine, based on 1 kg of emulsion.

The emulsions thus prepared were applied to a cellulose triacetate support covered with an adhesive layer, dried and hardened as described in Example 1. 1.2 g/m² of silver bromide and 1.7 g/m² of latex coupler were applied.

The samples were exposed, processed and assessed sensitometrically as described in Example 1.

TABLE 5

| Sample | maximum density | Gradation | $\lambda_{max}$ | |
|---|---|---|---|---|
| L 1 | 3.08 | 0.95 | 548 nm | comparison |
| L 2 | 3.22 | 1.09 | 550 nm | according to the invention |
| L 3 | 3.33 | 1.16 | 550 nm | according to the invention |
| L 4 | 3.58 | 1.26 | 548 nm | according to the invention |

Table 5 shows that the maximum density and the gradation may be increased by the addition of polyester carboxylic acids in their sodium salt form as emulsifying additives in the preparation of latex couplers.

EXAMPLE 4

A red sensitized cyan emulsion layer 15 μm in thickness was applied to a cellulose triacetate support covered with an anti-halation layer 4 μm in thickness consisting of gelatine and black colloidal silver.

The layer contained per m²:

8.129 g of gelatine
3.298 g of polyester carboxylic acid I-1
2.177 g of tricresyl phosphate
7.13 g of silver bromide and
2.7 g of cyan coupler corresponding to the following formula

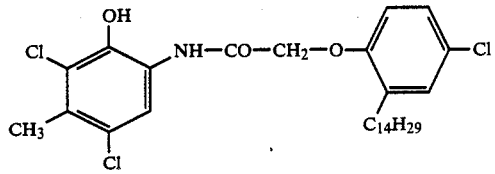

(40 vol.-% of gelatine and 20 vol.-% of polyester carboxylic acid I-1, based on the total solids content).

Equal quantities of polyester carboxylic acid I-2 and, for comparison, polyethyl acrylate were used in subsequent samples.

After drying, the layers were adjusted to a climate of 23° C and 20% relative humidity.

The breaking strength was determined by means of the following apparatus:

A loop of film arranged with the emulsion facing outwards is clamped into an apparatus with parallel jaws and load cell. Applying a squeezing rate of 10 cm/s, the movable jaw moves towards the fixed jaw as far as the double film thickness and then returns.

The force/path is plotted electronically and automatically by an XY registering apparatus.

When the film breaks.

1. the breaking force and
2. the diameter of the loop at breakage are measured. The higher the breaking force and the smaller the diameter of the loop, the less fragile is the film.

TABLE 6

| Additive | Break resistance (23° C., 20% relative humidity) Diameter of loop on breaking [mm] | Breaking force [N] |
|---|---|---|
| I-1 | 0.3 | 37 |
| I-2 | 0.3 | 32 |
| Polyethyl acrylate | 0.4 | 30 |
| Without additive | 0.5 | 28 |

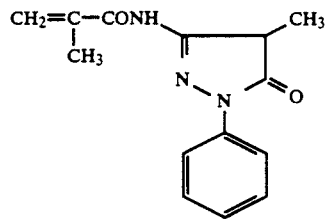

TABLE 7

| Latex | Polyester carboxylic acid $Na^+$ salt (quantity in % by wt., based on the monomer) | | Monomer | Average particle size [nm] | Foaming | Use in photographic material |
|---|---|---|---|---|---|---|
| 1 | I-2 | 5 | Butyl acrylate | 61 | — | plasticizer |
| 2 | I-2 | 10 | " | 51 | — | " |
| 3 | I-2 | 50 | " | 45 | — | " |
| 4 | I-2 | 10 | Methyl methacrylate | 59 | — | binder additive |
| 5 | I-2 | 50 | " | 25 | — | " |
| 6 | I-2 | 100 | " | 28 | — | " |
| 7 | I-3 | 10 | Ethyl acrylate | 28 | — | plasticizer |
| 8 | I-1 | 50 | Methyl methacrylate | 24 | — | binder additive |
| 9 | I-1 | 100 | " | 19 | — | " |
| 10 | I-1 | 10 | Ethyl acrylate | 53 | — | plasticizer |
| 11 | I-1 | 50 | " | 26 | — | " |
| 12 | I-1 | 100 | Coupler monomer W | 61 | — | white coupler |
| 13 | I-1 | 82 | Coupler monomer K/ methacrylamido undecanoic acid 55:45% by wt. | 69 | — | magenta coupler |

The results show that when polyester carboxylic acids according to this invention are used, the mechanical properties are improved and the layers have improved breakage resistance.

EXAMPLE 5

Latices were prepared from the sodium salts of the polyester carboxylic acids according to the invention (pH 7.8). The preparation of latex 1 is described below.

Method for Latex 1

2 g of Polyester carboxylic acid I-2 were dissolved in dilute NaOH under nitrogen so that a solution of 2 g of I-2 in 225 ml at pH 8 was obtained. After the solution had been heated to 90° C, 40 g of butyl acrylate and at the same time 40 g of a 1% by weight azo-bis-cyanovaleric acid sodium salt were added dropwise within one hour. After a further 2 hours' stirring at 90° C, a latex having a solids content of 13.7% by weight and an average particle size of 61 nm was obtained.

Latices 2–14 were prepared in analogous manner (Table 7).

The latices are distinguished by the fact that in comparison with latices prepared with conventional anionic emulsifiers, they have little tendency to troublesome foam formation. In addition, they are very finely divided and very readily miscible with the binders used in photographic materials, e.g. gelatine, so that clear layers are obtained when they are mixed with photographic casting solutions.

The following monomers were used in the latices: Coupler monomer K: Substance according to Example 3 Coupler monomer W:

EXAMPLE 6

A colour photographic recording material for colour negative development was prepared by applying the following layers in the given sequence to a transparent layer support of cellulose triacetate. The quantities given are based in each case on 1 $m^2$. The quantity of silver halide applied is given in terms of the corresponding quantity of $AgNO_3$. All silver halide emulsions were stabilized with 0.5 g of 4-hydroxy-6-methyl-1,3,3a,7-tetraazaindene per 100 g of $AgNO_3$.

Layer 1 (anti-halation layer)
  Black colloidal silver sol containing
  0.32 g of Ag and 2.2 g of gelatine
Layer 2 (interlayer)
  0.3 g of gelatine
Layer 3 (first red sensitized layer)
  Red sensitized silver chloroiodobromide emulsion
  (5 mol-% iodide: 2 mol-% chloride: average grain diameter 0.5 μm) of
  2.4 g of $AgNO_3$ with
  1.1 g of Emulsion E1 from Example 1,
  0.06 g of red mask MR-1,
  0.045 g of DIR coupler DC-1
  1.2 g of gelatine
Layer 4 (second red sensitized layer)
  Red sensitized silver iodobromide emulsion
  (10 mol-% iodide; average grain diameter 0.8 μm)
  obtained from 2.9 g of $AgNO_3$ with
  0.3 g of Emulsion E1 of Example 1,
  0.02 g of red mask MR-1 and
  0.04 g of DIR compound DC-2
Layer 5 (interlayer)
  0.9 g of gelatine
Layer 6 (first green sensitized layer)

Green sensitized silver iodobromide emulsion
(5 mol-% iodide: average grain diameter 0.4 μm)
obtained from 2.2 g of $AgNO_3$ with
0.65 g of magenta coupler PP12,
0.04 g of DIR coupler DC.3,
0.02 g of yellow mask MY-1 and
1.4 g of gelatine Layer 7 (second green sensitized layer)
Green sensitized silver iodobromide emulsion
(10 mol-% iodide: average grain diameter 0.8 μm)
obtained from 2.7 g of $AgNO_3$ with
0.17 g of magenta coupler PP 12,
0.04 g of yellow mask MY-1 and
1.6 g of gelatine Layer 8 (yellow filter layer)
Yellow colloidal silver sol containing
0.07 g of Ag and 0.32 g of gelatine Layer 9 (first blue-sensitive layer)
Silver iodobromide emulsion
(3 mol-% iodide: average grain diameter 0.3 μm)
obtained from 0.95 g of $AgNO_3$ with
0.96 g of yellow coupler GB 19 and
1.4 g of gelatine Layer 10 (second blue-sensitive layer)
Silver iodobromide emulsion
(8 mol-% iodide: average grain diameter 0.8 μm)
obtained from 1.0 g of $AgNP_3$ with
0.22 g of yellow coupler GB 19 and
1.6 g of gelatine Layer 11 (protective layer)
1.1 g of gelatine and
0.8 g of UV absorbent UV 7

Layer 12 (protective layer)
0.8 g of gelatine

Layer 13 (hardening layer)
0.3 g of gelatine and
0.9 g of hardener of Example 1.

The following formulae are of compounds not mentioned in the description

MR-1

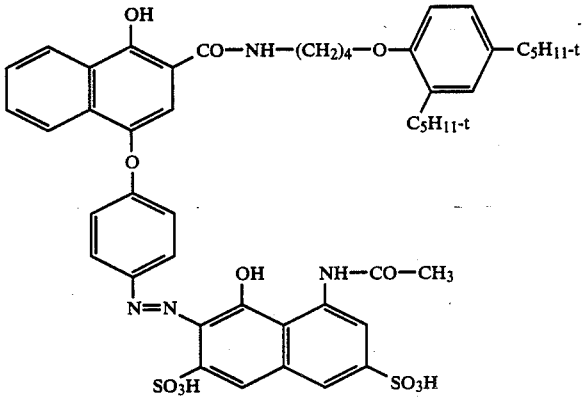

DC-1

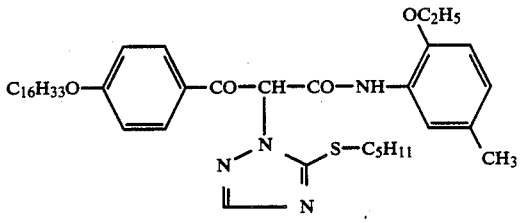

DC-2

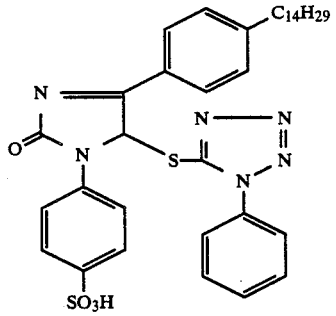

-continued

DC-3

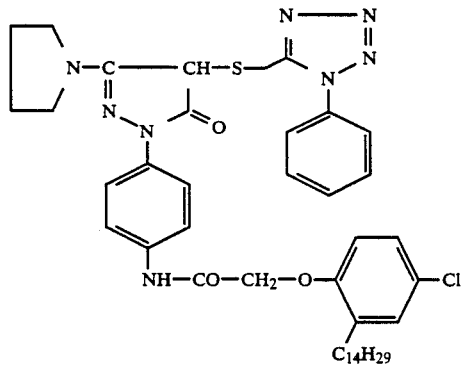

MY-1

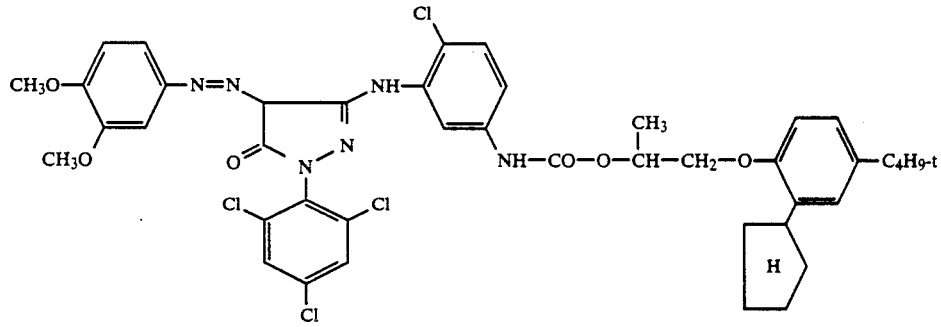

Various versions of the recording material arranged as described above were prepared. These versions differed only in the cyan coupler emulsion introduced into Layer 3 and Layer 4.

The samples obtained were exposed behind a graduated grey wedge and then developed by the process described by E.CH. Gehret, British J. of Photography 1974, page 597. The maximum cyan colour densities were then measured (see Table 8).

TABLE 8

| Version | Cyan emulsion of Example 1 | max. colour density | |
|---|---|---|---|
| A | E1 | 1.96 | comparison |
| B | E2 | 2.30 | according to the invention |
| C | E3 | 2.52 | according to the invention |
| D | E4 | 2.36 | according to the invention |
| E | E5 | 2.51 | according to the invention |

EXAMPLE 7

Structure of colour photographic paper I

A layer support of paper coated with polyethylene on both sides was covered with the following layers. The quantities given are based on 1 $m^2$.

1. A substrate layer of 200 mg of gelatine containing an addition of $KNO_3$ and chrome alum.
2. An adhesive layer of 320 mg of gelatine.
3. A blue-sensitive silver chlorobromide emulsion layer (20 mol-% chloride) of 450 mg of $AgNO_3$ containing 1600 mg of gelatine, 1.0 mmol of yellow coupler GB 12 and 27.7 mg of 2,5-dioctylhydroquinone, emulsified according to the invention with a polyester carboxylic acid (formulation 7.1). The emulsion was prepared with a grain size of 0.8 μm by the process of double inflow, flocculated in the usual manner, washed and redispersed with gelatine. The ratio by weight of gelatine to silver (as $AgNO_3$) was 0.5. The emulsion was then ripened to optimum sensitivity with 60 μmol of thiosulphate per mol of Ag, sensitized to the blue spectral region and stabilized.
4. An interlayer of 1200 mg of gelatine, 80 mg of 2.5-dioctylhydroquinone and 100 mg of tricresylphosphate.
5. A green-sensitive silver chlorobromide emulsion layer (20 mol-% chloride) of 530 mg $AgNO_3$ containing 750 mg of gelatine, 0.625 mmol of magenta coupler PP 3 and 43 mg of 2,5.dioctylhydroquinone, emulsified with polyester carboxylic acid (formulation 7.2).
6. An interlayer of 1550 mg of gelatine, 285 mg of UV-absorbent UV 4 80 mg of dioctylhydroquinone and 650 mg of tricresylphosph-tc
7. A red-sensitive silver chlorobromide emulsion layer (20 mol-% chloride) containing 400 mg of $AgNO_3$, 1470 mg of gelatine and 0.780 mmol of cyan coupler BG 24, emulsified with polyester carboxylic acid according to formulation (7.3).
8. An interlayer of 1200 mg of gelatine, 134 mg of the UV absorbent used in Layer 6 and 240 mg of tricresyl phosphate.

This arrangement of layers was covered with a protective layer containing, per $m^2$, 1 g of gelatine and 16 mg of wetting agent corresponding to the following formula $$C_8F_{17}SO_3^{\ominus}N(C_2H_5)_4^{\oplus}.$$

The dry layer thickness of this layer is approximately 1 μm. On this layer is applied a hardening layer containing, per $m^2$, 34 mg of phenol, 15.4 mg of the wetting agent used in the protective layer, 5.6 mg of saponin and 374 mg of the hardener of Example 1.

Comparison paper II

A colour photographic paper arrangement containing the same quantities of yellow, magenta and cyan couplers as arrangement I was prepared by the same method except that the colour coupler emulsions prepared according to methods V1.1, V2.1 and V3.1 were used.

Comparison paper III

Prepared in the same way as arrangement II but using colour coupler emulsions V1.2. V2.2 and V3.2.

The colour coupler emulsions are prepared in accordance with the following formulations:

| Formulation 7.1 Yellow coupler emulsion containing polyester carboxylic acid | | |
|---|---|---|
| I. | 25 | g of gelatine are dissolved in |
| | 197 | g of water and into this solution is stirred a mixture of |
| | 2.5 | g of polyester carboxylic acid I.1 and |
| | 5 | g of ethyl acetate. |
| II. | 25 | g of yellow coupler GB 12, |
| | 0.25 | g of dioctylhydroquinone, |
| | 11.2 | g of polyester carboxylic acid I.1 and |
| | 55 | g of ethyl acetate are mixed together and together emulsified with I. |

V1.1: Comparison formulation containing tricresylphosphate (TCP)

A yellow coupler emulsion is prepared in accordance with formulation 7.1 except that the polyester carboxylic acid used there is replaced by an equal quantity of tricresylphosphate and in addition 0.42 g of dodecylbenzene sulphonate is used as wetting agent in I.

V1.2: Comparison formulation containing polyester diol II-10

A yellow coupler emulsion is prepared in the same manner as formulation V1.1 except that instead of tricresylphosphate, an equal quantity of polyester diol II.10 is used, which is a starting material for the polyester carboxylic acid.

Formulation 7.2

Preparation of a magenta emulsion containing polyester carboxylic acid.

I. 0.4 kg of gelatine are dissolved in 5.1 kg of water.
A mixture of
0.075 kg of polyester carboxylic acid I.1 and
0.22 kg of ethyl acetate is stirred into the resulting solution.
II. A mixture of
1 kg of magenta coupler PP 3,
0.2 kg of 2,5-dioctylhydroquinone,
1 kg of polyester carboxylic acid I.1 and
2 kg of ethyl acetate
is emulsified in I.

V2.1: Comparison magenta emulsion containing conventional oil formers

A magenta emulsion is prepared in the same manner as formulation 7.2 except that instead of the polyester carboxylic acid, an equal quantity of an oil former mixture of dibutylphthalate (DBP)/tricreyslphosphate (TCP) 10:1 and 0.32 g of the compound corresponding to the following formula

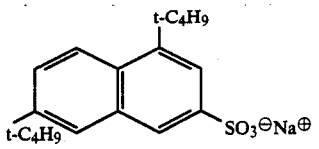

used as wetting agent are emulsified in I.

V2.2: Comparison magenta emulsion containing the polyester diol II.10 as oil former A magenta coupler emulsion is prepared in the same manner as formulation V2.1 except that instead of the oil former mixture DBP/TCP 10:1, the same quantity of polyester diol II.10 is used.

Formulation 7.3

Preparation of a cyan coupler emulsion containing polyester carboxylic acid

I. 4 g of gelatine are dissolved in 52 g of water.
To this solution is added a mixture of
1.6 g of ethyl acetate and
0.8 g of polyester carboxylic acid I.1.
II. A mixture of
8 g of cyan coupler BG 24,
7.2 g of polyester carboxylic acid I.1 and
12 g of ethyl acetate
is added to Mixture I and the mixture is emulsified.

V3.1: Cyan emulsion containing conventional oil formers for comparison

A cyan coupler emulsion is prepared according to formulation 7.3 except that instead of the polyester carboxylic acid, an equal quantity of the oil former mixture TBP/TCP 3:1 and 0.8 g of the wetting agent from V2.1 are added.

V3.2: Comparison cyan emulsion containing polyester diol II.10 as oil former

The emulsion is prepared in accordance with formulation V3.1 except that instead of the oil former mixture DBP/TCP 3:1, an equal quantity of polyester diol II.10 is used.

The samples obtained were exposed behind a graduated grey wedge and the papers were processed in the following baths as described below:

| | |
|---|---|
| Development: | 210 sec., 33° C. |
| Bleaching: | 50 sec., 20° C. |
| Fixing: | 60 sec., 20° C. |
| Washing: | 120 sec., 20° C. |
| Drying. | |

| Composition of the baths | |
|---|---|
| Developer: | |
| Benzyl alcohol | 13 ml |
| Hydroxyl ammonium sulphate | 3 g |
| Sodium sulphite | 2 g |
| 4-Amino-N-ethyl-N(β-methane-sulphon-amido-ethyl)-m-toluidine-sesquisulphate (monohydrate) | 4.5 g |
| Potassium carbonate | 36 g |
| Potassium bromide | 1.4 g |
| Pentasodium salt of diethylene-triamino- | 2 g |

-continued

| Composition of the baths | | |
|---|---|---|
| pentacetic acid | | |
| Diethylene glycol | 12 ml | |
| made up with water to 1 liter | | |
| pH = | 10.4 | |
| Bleaching bath: | Water | 700 ml |
| | $NH_4$—Fe-EDTA | 65 g |
| | EDTA | 10 g |
| | $NH_4Br$ | 100 g |
| | adjusted to pH 6.0 with acetic acid, made up with water to 1 liter | |
| Fixing bath: | Ammonium thiosulphate | 100 g |
| | Sodium sulphite sicc. | 10 g |
| | Sodium disulphite | 3 g |
| | made up with water to 1 liter. | |

The maximum colour densities of the yellow, cyan and magenta layers were then measured behind the corresponding filters.

TABLE 9

| Arrangement of colour photographic paper | Formulation | Oil former | relative sensitivity Yellow | Magenta | Cyan | Maximum colour density Yellow | Magenta | Cyan | Remarks |
|---|---|---|---|---|---|---|---|---|---|
| I | 7.1, 7.2, 7.3 | Polyester carboxylic acid | 100 | 100 | 100 | 2.30 | 2.25 | 2.20 | According to the invention |
| II | V1.1 | TCP | 85 | 90 | 85 | 1.80 | 1.75 | 1.90 | Comparison |
| | V2.1 | TBP/TCP | | | | | | | |
| | V3.1 | TBP/TCP | | | | | | | |
| III | V1.2, V2.2, V3.3 | Polyester diol II.10 | 90 | 80 | 90 | 1.90 | 1.80 | 1.85 | Comparison |

The data show that given the same emulsions, the sensitivity of the layers is increased and at the same time the maximum colour density increases in all colour layers by 10 - 20% compared with the comparison samples.

In addition, the combination of layers of Arrangement I contains less wetting agent capable of diffusing into the baths and giving rise to foaming.

The results of Comparison experiment III show that although the polyesterdiols may be used as oil formers, they do not give rise to outstanding maximum colour densities, compared with the polyester carboxylic acids. Moreover, when polyester diols are used as oil formers it is necessary to add a larger quantity of wetting agent for obtaining the desired small particle size.

EXAMPLE 8

Evidence of the combined oil former/wetting agent action of the polyester carboxylic acid according to the invention.

Preparation of a cyan coupler emulsion without wetting agent.

Formulation 8.1

I. 4 g of gelatine are dissolved in 52 g of water and to this solution is added a mixture of
1.6 g of ethyl acetate and
0.8 g of polyester carboxylic acid I.1.

II. A mixture of
8 g of cyan coupler BG 24,
7.2 g of polyester carboxylic acid I.1 and
12 g of ethyl acetate
is added to mixture I and emulsified. The ethyl ester is removed under vacuum.

For comparison, cyan coupler emulsions are prepared in the same manner in accordance with formulation 8.1 but instead of polyester carboxylic acid I.1 they contain Tricresylphosphate (TCP) in the case of VV1 and Polyester diol II.10 in the case of VV2.

The particle size and digestion stability of the emulsions are investigated.

The particle size is determined with an Autosizer II, Manufacturers: MALVERN.

The digestion stability is tested by leaving the emulsions at 40° C for 24 hours with stirring and then comparing the particle sizes before and after digestion.

| Results: Sample | Average particle diameter [nm] | Polydispersity |
|---|---|---|
| Formulation 8.1 before digestion | 239.5 | 0.053 |
| Formulation 8.1 after digestion | 255.2 | 0.060 |
| VV1 | 400.9 | 0.270 |
| VV2 | 429.1 | 0.287 |

Without the addition of wetting agent, the cyan emulsion prepared with the polyester carboxylic acid according to the invention has an excellent low particle size which has undergone hardly any change even after 24 hours'digestion. The cyan coupler emulsions prepared with the oil former TCP (VV1) and the oil former polyester diol (VV2) have much coarser particles and a higher polydispersity After digestion, the particles increase in size so much that they can no longer be measured.

The polyester carboxylic acid according to the invention combines good solvent properties for the colour couplers with excellent wetting action.

We claim:

1. Photographic silver halide recording material comprising a support, at least one light-sensitive silver halide emulsion layer, a protective layer and optionally other layers, characterised in that at least one layer which is arranged closer to the support than the protective layer contains a compound which, in the form of the free acid, corresponds to the following formula

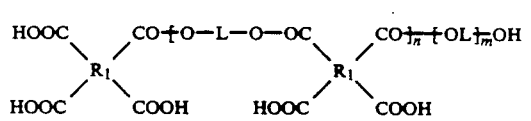

(I)

wherein $R_1$ denotes alkylene, arylene, aralkylene or cycloalkylene,

L denotes the residue of a polyester diol having an average molecular weight of from 500 to 20,000, m denotes 0 or 1, n denotes 0 to 30, preferably 0 to 10, and $m+n \geqq 1$.

2. Photographic silver halide recording material according to claim 1, characterised in that the compounds corresponding to formula I have acid numbers of from 30 to 340 mg KOH/g.

3. Photographic silver halide recording material according to claim 1, characterised in that the compounds corresponding to formula I have acid numbers of from 50 to 200 mg KOH/g.

4. Photographic silver halide recording material according to claim 1, characterised in that it contains from 0.02 to 5.0 g/m$^2$ of the compound corresponding to formula I in the form of the free acid.

5. Photographic silver halide recording material according to claim 1, characterised in that it contains from 0.01 to 3.0 g/m$^2$ of the compound of formula I in anionic form.

6. Photographic silver halide recording material according to claim 1, characterised in that the polyester diols corresponding to the following formula $$HO - L - OH$$

are formed from diols corresponding to the following formula $$HO - R_2 - OH$$

and dicarboxylic acids corresponding to the following formula $$HOOC - (R_3)_q - COOH$$

wherein $R_2$ denotes a divalent hydrocarbon group containing 2 to 13 carbon atoms, $R_3$ denotes a divalent hydrocarbon group containing 2 to 13 carbon atoms and q denotes 0 or 1.

* * * * *